US005272051A

United States Patent [19]

Shimada et al.

[11] Patent Number: 5,272,051

[45] Date of Patent: Dec. 21, 1993

[54] SILVER HALIDE COLOR PHOTOGRAPHIC MATERIAL

[75] Inventors: Yasuhiro Shimada; Yoshio Ishii, both of Kanagawa, Japan

[73] Assignee: Fuji Photo Film Co., Ltd., Kanagawa, Japan

[21] Appl. No.: 788,432

[22] Filed: Nov. 6, 1991

[30] Foreign Application Priority Data

Nov. 26, 1990 [JP] Japan ..... 2-322051

[51] Int. Cl.[5] ..... G03C 7/38

[52] U.S. Cl. ..... 430/558

[58] Field of Search ..... 430/558, 384, 385, 549, 430/505

[56] References Cited

U.S. PATENT DOCUMENTS 4,728,598 3/1988 Bailey et al. ..... 430/387
4,910,127 3/1990 Sakaki et al. ..... 430/546
5,206,130 4/1993 Shimada et al. ..... 430/558

FOREIGN PATENT DOCUMENTS 3264755 11/1988 Japan ..... 430/558

*Primary Examiner*—Lee C. Wright
*Attorney, Agent, or Firm*—Sughrue, Mion, Zinn, Macpeak & Seas

[57] ABSTRACT

A silver halide color photographic material is disclosed, which comprises a support thereon having at least one red-sensitive silver halide emulsion layer, in which the red-sensitive silver halide emulsion layer contains at least one cyan coupler of the general formula (I):

(I)

wherein

R represents a substituent;

EWG represents an electron-attracting substituent which does not substantially split off from the formula on reaction of the coupler with an oxidation product of an aromatic primary amine developing agent; EWG' represents an electron-attracting substituent having a Hammett's substituent constant $\sigma_p$ of 0.3 or more, other than a perfluoroalkyl group; and W represents a hydrogen atom or a releasable group which splits off on reaction of the coupler with an oxidation product of an aromatic primary amine developing agent.

6 Claims, No Drawings

SILVER HALIDE COLOR PHOTOGRAPHIC MATERIAL

FIELD OF THE INVENTION

The present invention relates to a silver halide color photographic material and, more precisely, to one having an excellent color reproducibility.

BACKGROUND OF THE INVENTION

It is well known that a silver halide color photographic material contains so-called dye-forming couplers (hereinafter simply referred to as "couplers") which form yellow, magenta and cyan dyes by a coupling reaction with an oxidation product of an aromatic primary amine developing agent to produce a color image.

Principles of color photography using couplers and general examples of couplers are described, for example, in T.H. James, *The Theory of the Photographic Process*, 4th Ed., Chap. 12 (published by Macmillan Co., 1977) and *Research Disclosure*, Item No. 17643 (December, 1978).

The above-mentioned publications disclose that phenols and naphthols have heretofore been used as cyan couplers.

However, cyan images to be formed from such conventional phenol and naphthol cyan couplers have a significant problem color reproducibility. The problem of cyan dyes produced from conventional phenol and naphthol cyan couplers occurs due to the poor toe sharpness in the short-wave side absorption so that the cyan dyes have an unnecessary absorption in the green range. In addition, since cyan dyes have an asymmetric absorption also in the blue range, the color reproducibility of the couplers is worsened to an even greater extent. In order to improve color reproducibility, a technique of incorporating a pyrazoloazole cyan coupler into at least one red-sensitive silver halide emulsion layer of a photographic material is disclosed in JP-A-64-552 and 64-554. (The term "JP-A" as used herein mean an "unexamined published Japanese patent application".) However, it has been found that the couplers disclosed in these Japanese patent applications do not have sufficient color reproducibility, the couplers have a low coupling activity and the light-fastness of the cyan images formed from the couplers is poor. As a result, the illustrated cyan couplers are not practical for use.

Couplers as illustrated in U.S. Pat. No. 4,728,598 have a maximum absorption wavelength range of from 538 nm to 602 nm and have a broad absorption so that they also are not sufficient as cyan couplers.

SUMMARY OF THE INVENTION

A first object of the present invention is to provide a silver halide color photographic material providing a sharp cyan image having excellent spectral absorption characteristics.

A second object of the present invention is to provide a silver halide color photographic material forming a cyan image with excellent light fastness.

A third object of the present invention is to provide a silver halide color photographic material with excellent color reproducibility.

The objects of the present invention are attained by a silver halide color photographic material comprising a support having thereon at least one red-sensitive silver halide emulsion layer thereon, in which the red-sensitive silver halide emulsion layer contains at least one cyan coupler of a general formula (I):

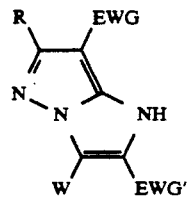

(I)

where

R represents a substituent;

EWG represents an electron-attracting substituent which is not substantially split off from the formula by reaction of the coupler with an oxidation product of an aromatic primary amine developing agent;

EWG' represents an electron-attracting substituent other than a perfluoroalkyl group;

W represents a hydrogen atom or a releasable group which splits off by reaction of the coupler with an oxidation product of an aromatic primary amine developing agent.

One preferred embodiment of the invention comprises a silver halide color photographic material which contains at least one pyrazoloazole magenta coupler.

Cyan couplers of formula (I) present in the photographic material of the present invention are characterized by the combination of the groups EWG and EWG' in the imidazopyrazole skeleton. Specifically, because of introduction of the groups EWG and EWG' into the skeleton, the dyes derived from the couplers have spectral absorption characteristics characterized by a maximum absorption wavelength ($\lambda_{max}$) within the range of from 600 to 700 nm and by a sharpness of the toe in the short-wave side with little side absorption therein.

DETAILED DESCRIPTION OF THE INVENTION

Now, the present invention will be explained in detail hereunder.

In formula (I), R represents a substituent. For instance, it is a halogen atom (e.g., chlorine, bromine), a linear or branched, acyclic or 5 to 8-membered cyclic having at least one of hetero atoms, such as N, S, O, saturated or unsaturated, and substituted or unsubstituted aliphatic group having a total carbon number of 1 to 50, preferably 1 to 36 (e.g., methyl, propyl, t-butyl, trifluoromethyl, tridecyl, 3-(2,4-di-t-amyphenoxy)propyl, 2-dodecyloxyethyl, 3-phenoxypropyl, 2-hexylsulfonylethyl, cyclopentyl, benzyl, allyl, propargyl), a heterocyclic group (e.g., 2-furyl, 2-thienyl, 2-pyrimidyl, 2-benzothiazolyl), a cyano group, an alkoxy group (e.g., methoxy, ethoxy, 2-methoxyethoxy, 2-dodecyloxyethoxy, 2-methanesulfonylethoxy), an aryloxy group (e.g., phenoxy, 2-methylphenoxy, 4-t-butylphenoxy), a heterocyclic-oxy group (e.g., 2-benzimidazolyloxy), an acyloxy group (e.g., acetoxy, hexadecanoyloxy), a carbamoyloxy group (e.g., N-ethycarbamoyloxy), a silyloxy group (e.g., trimethsilyloxy), a sulfonyloxy group (e.g., dodecylsulfonyloxy), an acylamino group (e.g., acetamido, benamido, tetradecanamido, o-(2,4-di-t-amyphenoxybutyamido, 2,4-di-t-amylphenoxyacetamido, α-{4-(4-hydroxyphenysulfonylphenoxy)} decanamido, isopentadecanamido), an anilino group (e.g., phenylamino, 2-chloroanilino, 2-chloro-5-tetradecanamidanilino, 2-chloro-5-dodecyloxycarbonylanilino, N-acetylanilino, 2-chloro-5-{α-(2-t-butyl-4-hydroxyphenoxy)-dodecanamido}anilino), an ureido group (e.g., phenylureido, methylureido, N,N-dibutylureido), an imido group (e.g., N-succinimido, 3-benzylhydantoinyl, 4-(2-ethylhexanoylamino)phthalimido), a sulfamoylamino group (e.g., N,N-dipropylsulfamoylamino, N-methyN-decylsulfamoylamino), an alkylthio group (e.g., methylthio, octylthio, tetradecylthio, 2-phenoxyethylthio, 3-phenoxypropylthio, 3-(4-t-butylphenoxy)-propylthio), an arylthio group (e.g., phenylthio, 2-butoxy-5-t-octylphenylthio, 3-pentadecylphenylthio, 2-carboxyphenylthio, 4-tetradecanamidophenylthio), a heterocyclicthio group (e.g., 2-benzothiazolylthio), an alkoxycarbonylamino group (e.g., methoxycarbonylamino, tetradecyloxycarbonylamino), an aryloxycarbonylamino group (e.g., phenoxycarbonylamino, 2,4-di-tert-butylphenoxycarbonylamino), a sulfonamido group (e.g., methanesulfonamido, hexadecansulfonamido, benzenesulfonamido, p-toluenesulfonamido, octadecanesulfonamido, 2-methyloxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-tert-amylphenoxy)propyl}carbamoyl), an aliphatic or aromatic acyl group (e.g., acetyl, (2,4-di-tert-amylphenoxy)acetyl, benzoyl), an aliphatic or aromatic sulfamoyl group (e.g., N-ethylsulfamoyl, N,N-dipropylsulfamoyl, N-(2-dodecyloxyethylsulfamoyl, N-ethyl-N-dodecylsulfamoyl, N,N-diethylsulfamoyl), an aliphatic or aromatic sulfonyl group (e.g., methanesulfonyl, octanesulfony, benzenesulfonyl, toluenesulfonyl), an aliphatic or aromatic sulfinyl group (e.g., octanesulfinyl, dodecylsulfinyl, phenylsulfinyl), an alkoxycarbonyl group (e.g., methoxycarbonyl, butyloxycarbonyl, dodecyloxycarbonyl, octadecyloxycarbonyl), an aryloxycarbonyl group (e.g., phenyloxycarbonyl, 3-pentadecyloxycarbonyl), or an aromatic group having from 6 to 36 carbon atoms (e.g., phenyl, naphthyl). Where R is an aromatic group which includes monocyclic and bicyclic groups, it may be substituted by one or more substituents selected from those described above.

In formula (I), EWG represents an electron-attracting substituent which does not substantially split off from the formula on reaction of the coupler with an oxidation product of an aromatic primary amine developing agent.

The electron-attracting substituent is a group which has a Hammett's substituent constant $\sigma_p$ of 0 (zero) or more and which does not substantially split off from the formula on reaction of the coupler with an oxidation product of an aromatic primary amine developing agent.

The value of the Hammett's substituent constant $\sigma_p$ as referred to herein is as described in Hansch, C. Leo et al's report (e.g., *J. Med. Chem.*, 16, 1207 (1973); ibid., 20, 304 (1977)).

For example, EWG represents a cyano group, a carbamoyl group (e.g., N-phenylcarbamoyl, N-(2-chloro-5-tetradecyloxycarbonylphenyl)carbamoyl, N,N-diethylcarbamoyl, N-(2,4-di-chlorophenyl)carbamoyl, N-(2-chloro-5-hexadecansulfonamidophenyl)carbamoyl), an alkoxycarbonyl group (e.g., ethoxycarbonyl, butoxycarbonyl, dodecyloxycarbonyl, 2-ethylhexyloxycarbonyl), an aryloxycarbonyl group (e.g., phenoxycarbonyl, 1-naphthyloxycarbonyl), an aliphatic or aromatic acyl group (e.g., benzoyl, acetyl, 4-chlorobenzoyl, 2,4-dichlorobenzoyl), an aliphatic or aromatic sulfonyl group (e.g., methanesulfonyl, dodecanesulfonyl, benzenesulfonyl, 2-butoxy-5-t-octylphenylsulfonyl), an aliphatic or aromatic sulfamoyl group (e.g., N-butylsulfamoyl, N-phenylsulfamoyl, N,N-diethylsulfamoyl), a nitro group, a fluoroalkyl group (e.g., trifluoromethyl, heptafluoropropyl), a fluoroaryl group (e.g., pentafluorophenyl), a sulfinyl group (e.g., methanesulfinyl, benzenesulfinyl, naphthalenesulfinyl), or an aromatic group (e.g., phenyl, 4-chlorophenyl, 4-acetamidophenyl). EWG has a total carbon number of 1 to 50, preferably 1 to 36.

Preferably, EWG is a cyano group, a carbamoyl group, an alkoxycarbonyl group, an aliphatic or aromatic acyl group, an aliphatic or aromatic sulfonyl group, or an aliphatic or aromatic sulfamoyl group.

In formula (I), EWG′ represents an electronattracting substituent having a Hammett's substituent constant $\sigma_p$ of 0.3 or more, other than a perfluoroalkyl group. For instance, EWG′ is a cyano group, a carbamoyl group (e.g., N-phenylcarbamoyl, N-(2-chloro-5-tetradecyloxycarbonylphenyl)carbamoyl, N,N-diethylcarbamoyl, N-(2,4-dichlorophenyl)carbamoyl, N-(2-chloro-5-hexadecanesulfonamidophenyl)carbamoyl), an alkoxycarbonyl group (e.g., ethoxycarbonyl, butoxycarbonyl, dodecyloxycarbonyl, 2-ethylhexyloxycarbonyl), an aryloxycarbonyl group (e.g., phenoxycarbonyl, 1-naphthyloxycarbonyl), an aliphatic or aromatic acyl group (e.g., benzoyl, acetyl, 4-chlorobenzoyl, 2,4-dichlorobenzoyl), an aliphatic or aromatic sulfonyl group (e.g., methanesulfonyl, dodecanesulfonyl, benzenesulfonyl, 2-butoxy-5-t-octylphenylsulfonyl), a sulfamoyl group (e.g., N-butylsulfamoyl, N-phenylsulfamoyl, N,N-diethylsulfamoyl), a nitro group, a fluoroaryl group (e.g., pentafluorophenyl), or a sulfinyl group (e.g., methanesulfinyl, benzenesulfinyl, naphthalenesulfinyl).

Preferably, EWG′ is a cyano group, an alkoxycarbonyl group, an aliphatic or aromatic acyl group, an aliphatic or aromatic sulfonyl group, or an aliphatic or aromatic sulfamoyl group.

In formula (I), W represents a hydrogen atom or a releasable group or atom (hereinafter simply referred to as releasable groups) which splits off from the formula on reaction of the coupler with an oxidation product of an aromatic primary amine developing agent. Examples of releasable groups for W include a halogen atom; an aromatic azo group; a group bonded to an aliphatic group, an aromatic group, a heterocyclic group, an aliphatic, aromatic or heterocyclic sulfonyl group, or an aliphatic, aromatic or heterocyclic carbonyl group, via an oxygen, nitrogen, sulfur or carbon atom; or a heterocyclic group bonded to the coupling position of the formula via a nitrogen atom of the group. The aliphatic, aromatic or heterocyclic group moiety in the releasable group may optionally be substituted by one or more substituents such as those hereinabove described for R. Where the moiety is substituted by two or more substituents, they may be same or different, and the substituents may further be substituted by other substituent(s) such as those as also described for R. W has a total carbon number of 1 to 36, preferably 1 to 20.

Specific examples of the releasable groups are a halogen atom (e.g., fluorine, chlorine, bromine), an alkoxy group (e.g., ethoxy, dodecyloxy, methoxyethylcarbamoylmethoxy, carboxypropoxy, methylsulfonylethoxy), an aryloxy group (e.g., 4-chlorophenoxy, 4-methoxyphenoxy, 4-carboxyphenoxy), an acyloxy group (e.g., acetoxy, tetradecanoyloxy, benzoyloxy), an aliphatic or aromatic sulfonyloxy group (e.g., methanesulfonyloxy, toluenesulfonyloxy), an acylamino group (e.g., dichloroacetylamino, heptafluorobutyrylamino), an aliphatic or aromatic sulfonamido group (e.g., methanesulfonamido, p-toluenesulfonamido), an alkoxycarbonyloxy group (e.g., ethoxycarbonyloxy, benzylcarbonyloxy), an aryloxycarbonyloxy group (e.g., phenoxycarbonyloxy), an aliphatic, aromatic or heterocyclic thio group (e.g., ethylthio, 2-carboxyethylthio, phenylthio, tetrazolylthio), a carbamoylamino group (e.g., N-methylcarbamoylamino, N-phenylcarbamoylamino), a 5-membered or 6-membered nitrogen-containing heterocyclic group (e.g., imidazolyl, pyrazolyl, triazolyl, tetrazolyl, 1,2-dihydro-2-oxo-1-pyridyl), an imido group (e.g., succinimido, hydantoinyl), an aromatic azo group (e.g., phenylazo), and a carboxyl group. These releasable groups may optionally be substituted by one or more substituents as selected from those described for R. Preferably, at least one of R, EWG, EWG' and X in the cyan coupler of formula (I) for use in the present invention has from 10 to 50 carbon atoms.

Specific examples of cyan couplers of formula (I) for use in the present invention are described below, but the present invention is not be construed as being limited to these compounds.

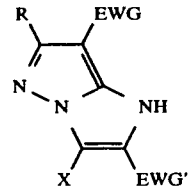
(I)
| No. | R | EWG | EWG' | X |
|---|---|---|---|---|
| 1. | $-C_{17}H_{35}$ | $-CN$ | $-CN$ | H |
| 2. | 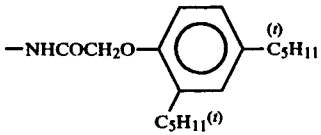 | $-CO_2CH_2CH_3$ | $-CN$ | Cl |
| 3. | 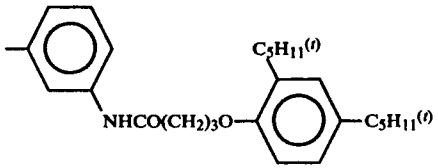 | 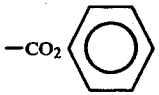 | 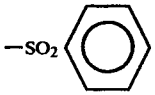 | H |
| 4. | $-C_4H_9^{(t)}$ | $-CONHC_{12}H_{25}$ | $-CO_2CH_2CH_3$ | H |
| 5. | 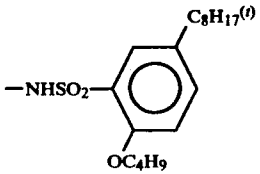 | $-CN$ | $-CO_2CH_2CH_3$ | Cl |
| 6. | 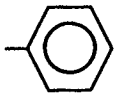 | 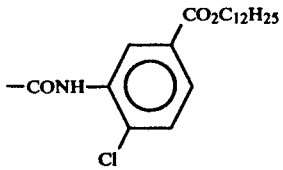 | $-SO_2NHCH_3$ | H |

-continued
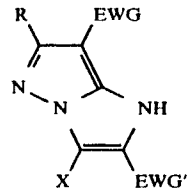
(I)
| No. | R | EWG | EWG' | X |
|---|---|---|---|---|
| 7. | 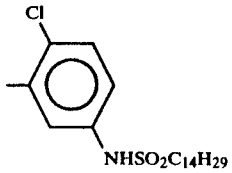 | $-CO_2CH_2CH_3$ | $-CN$ | 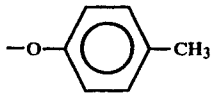 |
| 8. | 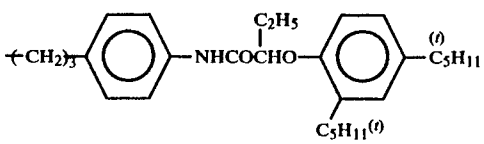 | $-CN$ | 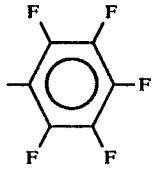 | H |
| 9. | 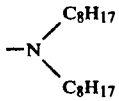 | 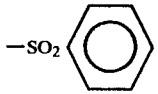 | 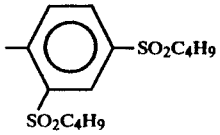 | H |
| 10. | $-C_{17}H_{35}$ | $-CN$ | 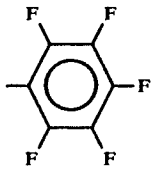 | H |

-continued
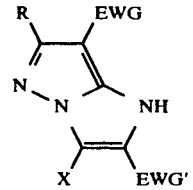
(I)
| No. | R | EWG | EWG' | X |
|---|---|---|---|---|
| 11. | 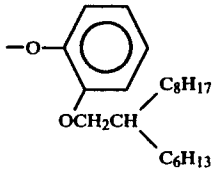 | $-CO_2CH_2CH_3$ | 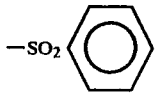 | Cl |
| 12. | $-CO_2C_{12}H_{25}$ | $-CF_3$ | $-CN$ | 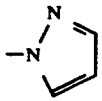 |
| 13. | $-NH(CH_2)_3OCH_{12}H_{25}$ | $-CN$ | $-CO_2C_2H_5$ | H |
| 14. | 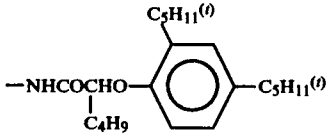 | $-CN$ | $-SO_2CH_3$ | Cl |
| 15. | 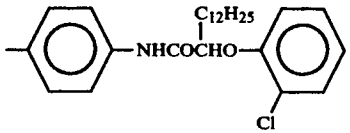 | $-CONH_2$ | $-CN$ | 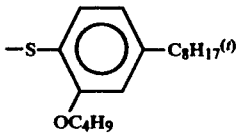 |
| 16. | $-CH_2CH_3$ | 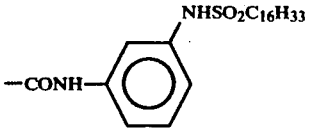 | 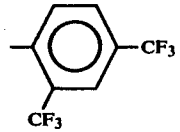 | Cl |

-continued
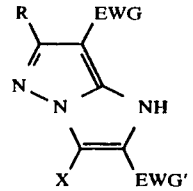
(I)
| No. | R | EWG | EWG' | X |
|---|---|---|---|---|
| 17. | 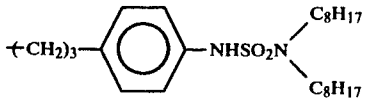 | $-CO_2CH_3$ | 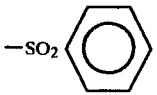 | H |
| 18. | 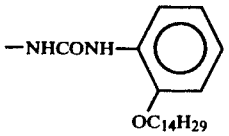 | $-CN$ | $-CN$ | H |
| 19. | $-C_{12}H_{25}$ | $-CN$ | $-CO_2CH_3$ | 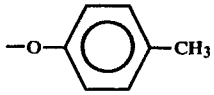 |
| 20. | 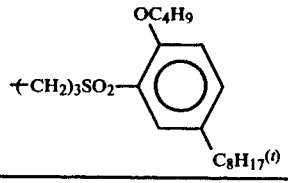 | $-CF_3$ | 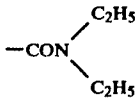 | 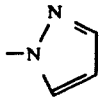 |

The cyan couplers of formula (I) of the present invention can be prepared by known methods, for example, by reference to disclosures of U.S. Pat. No. 4,728,598; *Pyrazoles, Pyrazolines, Pyrazolidines, Indazoles and Condensed Rings*, edited by R.H. Wiley (published by Interscience, New York, 1967); *J. Heterocycl. Chem.*, 1979, 16, 1109; and Chem., Ber., 1962, 95, 2861.

For introduction of a releasable group into the cyan couplers of formula (I), the following methods may be employed (1) Halogen Atom X is most typically Cl. For introduction of Cl as X, a compound of formula (I) where X is H is chlorinated in a halohydrocarbon solvent (e.g., chloroform, methylene chloride) with sulfuryl chloride or N-chlorosuccinimide.

(2) O-Releasable Group (i) A 4-equivalent coupler is halogenated at the coupling position and then it is reacted with a phenol compound in the presence of a base.

(ii) A 4-equivalent coupler with a hydroxyl group at the coupling position is reacted with an active halide compound in the presence of a base. p (3) S-Releasable Group (i) A 4-equivalent coupler is reacted with a sulfenyl chloride which is to be the releasable group, in the presence or absence of a base.

(ii) A mercapto group is introduced into the coupling position of a 4-equivalent coupler, and the mercapto group is reacted with a halide.

(4) N-Releasable Group (i) A 4-equivalent coupler is nitrosoated with an appropriate nitrosoating agent at the coupling position, it is reduced using an appropriate method (for example, by hydrogenation using a catalyst of Pd-carbon or the like; or by chemical reduction using stannous chloride or the like), and thereafter the reduced product is reacted with a halide.

(ii) A 4-equivalent coupler is halogenated with an appropriate halogenating agent (e.g., sulfuryl chloride) at the coupling position, and thereafter a nitrogen-containing hetero ring is replaced by an appropriate substituent by a method, e.g., as described in JP B-56-45135 in the presence of a basic catalyst. (The term "JP-B" as used herein means an "examined Japanese patent publication".)

(iii) a $6\pi$ or $10\pi$ electron type aromatic nitrogen-containing hetero ring is introduced into a halogenated coupler in the presence or absence of an aprotic polar solvent.

Further, the disclosures of U.S. Pat. Nos. 3,894,875, 3,933,501, 4,296,199, 3,227,554, 3,476,563, 4,296,200, 4,234,678, 4,228,233, 4,351,897, 4,264,723, 4,366,237, 3,408,194, 3,725,067, 3,419,391 and 3,926,631; JP-B-56-45135 and 57-36577; and JP-A-57-70871, 57-96343, 53-52423, 51-105820, 53-129035 and 54-48540 may be referred to for introduction of such releasable groups.

Examples illustrating the synthesis of cyan couplers of formula (I) are set forth below. Unless otherwise indicated herein, all parts, percents, ratios and the like are by weight.

Synthesis Example 1

Production of Compound (8)

Compound (8) was produced in accordance with the following reaction scheme.

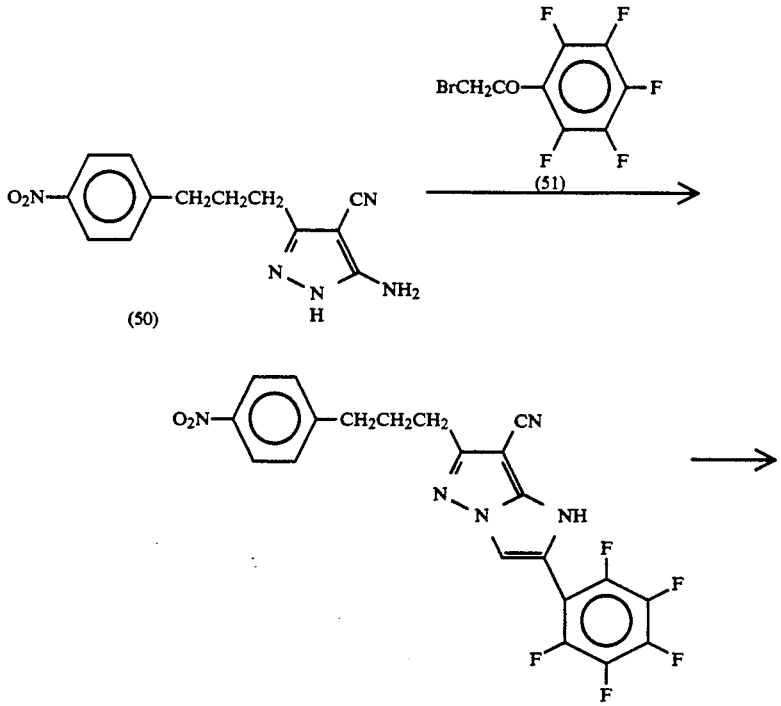

-continued

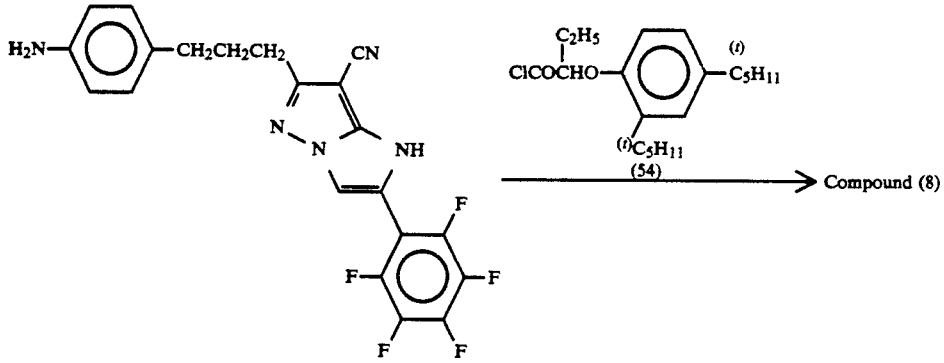

Production of Compound (52)

9.3 ml of 28 % methanol solution of sodium methylate was added to an anhydrous tetrahydrofuran solution of 10.0 g of Compound (50), and a tetrahydrofuran solution of 13.9 g of Compound (51) was dropwise added thereto under reflux. After reaction, 200 ml of ethyl acetate and 200 ml of water were added to the reaction system for extraction. The ethyl acetate layer was dried and the ethyl acetate was removed by distillation under reduced pressure. The residue was isolated by column chromatography to obtain 1.1 g of Compound (52).

Production of Compound (8)

720 mg of the thus obtained Compound (52) was dissolved in 20 ml of ethanol and 5 ml of water, and 1.7 g of sodium hydrosulfite was added thereto little by little with maintaining the bath temperature at 50° C. After reaction, the excess sodium hydrosulfite was removed, and ethyl acetate was added to the reaction mixture, which was then washed with water. The ethyl acetate layer was dried, and ethyl acetate was removed by distillation under reduced pressure, to obtain 550 mg of Compound (53). Compound (53) was dissolved in acetonitrile, and 600 mg of Compound (54) was dropwise added thereto at room temperature (about 20–30° C.). The crystals precipitated were moved by filtration to obtain 950 mg of the intended Compound (8).

Synthesis Example 2

Production of Compound (13)

Compound (13) was produced in accordance with the following reaction scheme.

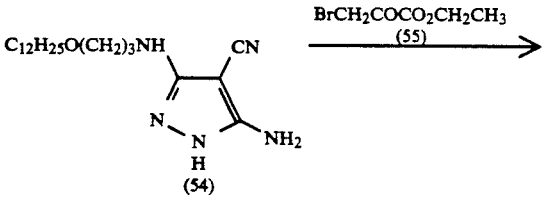

3.50 g of Compound (54) was dissolved in 50 ml of acetonitrile, 2.0 ml of a 28 % methanol solution of sodium methylate was added thereto, and 2.0 g of Compound (55) was gradually and dropwise added thereto under reflux. After reaction, ethyl acetate was added to the reaction system, which was then washed with water. The ethyl acetate layer was dried, and ethyl acetate was removed by distillation under reduced pressure. The residue was purified by column chromatography to obtain 1.0 g of Compound (13).

The silver halide color photographic material of the present invention contains the particular cyan coupler of formula (I) in the red-sensitive silver halide emulsion layer.

A conventional color photographic material comprises at least one blue-sensitive silver halide emulsion layer, at least one green-sensitive silver halide emulsion layer and at least one red-sensitive silver halide emulsion layer in this order on a support, but the order of the layers may be different. If desired, an infrared-sensitive silver halide emulsion layer may be substituted for at least one of the said light-sensitive emulsion layers. Each of the light-sensitive emulsion layers may contain a silver halide emulsion with a sensitivity to light of the corresponding wavelength range and a color coupler forming a dye which is complementary to the light to which the emulsion is sensitive, whereby color reproduction by a subtractive color photographic process is possible in the respective emussion layers. However, the relationship between the light-sensitive emulsion layer and the color hue of the dye formed from the color coupler therein is not limited to only the above-described arrangement.

The amount of the cyan coupler of formula (I) present in the red-sensitive silver halide emulsion layer in the photographic material of the present invention may be from $1\times10^{-3}$ mol to 1 mol, preferably from $2\times10^{-3}$ mol to $3\times10^{-1}$ mol, per mol of silver halide in the layer.

The coupler of formula (I) of the present invention can be incorporated into the red-sensitive silver halide emulsion layer of a photographic material using various known dispersion methods. One preferred example is an oil-in-water dispersion method where a coupler of formula (I) is dissolved in a high boiling point organic solvent (if necessary, along with a low boiling point organic solvent), the resulting solution is dispersed in an aqueous gelatin solution by emulsification and the dispersion is added to a silver halide emulsion.

Examples of high boiling point organic solvents usable in such an oil-in-water dispersion method are described in U.S. Pat. No. 2,322,027. The details and specific examples of dispersion in a latex, as one example of a polymer dispersion method, and the effect of such a dispersion method, as well as examples of latexes usable for impregnation in the step are described in U.S. Pat. No. 4,199,363, German Patent OLS Nos. 2,541,274 and 2,541,230, JP-B-53-41091 and European Patent Laid-Open No. 029104. The details of dispersion of an organic solvent-soluble polymer are described in PCT W088/00723.

Examples of high boiling point organic solvents usable in the above-mentioned oil-in-water dispersion method are phthalates (e.g., dibutyl phthalate, dioctyl phthalate, dicyclohexyl phthalate, di-2-ethylhexyl phthalate, decyl phthalate, bis(2,4-di-tert-amylphenyl) isophthalate, bis(1,1-diethylpropyl) phthalate), phosphates and phosphonates (e.g., diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridodecyl phosphate, di-2-ethylhexylphenyl phosphonate), benzoates (e.g., 2-ethylhexyl benzoate, 2,4-dichlorobenzoate, dodecyl benzoate, 2-ethylhexyl p-hydroxybenzoate), amides (e.g., N,N-diethyldodecanamide, N,N-diethyllaurylamide), alcohols or phenols (e.g., isostearyl alcohol, 2,4-di-tert-amylphenol), aliphatic esters (e.g., dibutoxyethyl succinate, di-2-ethylhexyl succinate, 2-hexyldecyl tetradecanoate, tributyl citrate, diethyl azelate, isostearyl lactate, trioctyl citrate), aniline derivatives (e.g., N,N-dibutyl-2-butoxy-5-tert-octylaniline), chlorinated paraffins (e.g., paraffins having a chlorine content of from 10% to 80%), trimesates (e.g., tributyl trimesate), dodecylbenzene, di-isopropylnaphthalene, phenols (e.g., 2,4-di-tert-amylphenol, 4-dodecyloxyphenol, 4-dodecyloxycarbonylphenol, 4-(4-dodecyloxyphenylsulfonyl)phenol), carboxylic acids (e.g., 2-(2,4-di-tert-amylphenoxybutyric acid, 2-ethoxyoctandedecanoic acid), and alkyl phosphates (e.g., di-(2-ethylhexyl) phosphate, diphenyl phosphate). If desired, an organic solvent having a boiling point of from about 30° C to about 160° C can be used as an auxiliary solvent. Examples of suitable auxiliary solvents are ethyl acetate, butyl acetate, ethyl propionate, methyl ethyl ketone, cyclohexanone, 2-ethoxyethyl acetate, and dimethylformamide.

The high boiling point organic solvent is generally used in an amount of from 0 to 2.0 times by weight, preferably from 0 to 1.0 time by weight, to the coupler.

The couplers of formula (I) of the present invention can be employed in, for example, color papers, color reversal papers, direct positive color photographic materials, color negative films, color positive films, and color reversal films. In particular, use in color photographic materials having a reflective support (for example, color papers or color reversal papers) is preferred.

The silver halide emulsion which can be used in the present invention may have any halogen composition and examples include emulsions of silver iodobromide, silver iodochlorobromide, silver bromide, silver chlorobromide or silver chloride.

The preferred halogen composition varies, depending upon the kind of the photographic material in which the coupler of the invention is employed. For a color paper, a silver chlorobromide emulsion is preferred. For a picture-taking photographic material such as a color negative film or color reversal film, a silver iodobromide emulsion with a silver iodide content of from 0.5 to 30 mol% (preferably, from 2 to 25 mol%) is preferred. For a direct positive color photographic material, a silver bromide or silver chlorobromide emulsion is preferred. For a color paper photographic material for rapid processing, a so-called high silver chloride emulsion with a high silver chloride content is preferred. The silver chloride content in this type of high silver chloride emulsion is preferably 90 mol% or more, more preferably 95 mol% or more.

In such a high silver chloride emulsion, it is preferred that a silver bromide localized phase is in the inside and/or surface of the silver halide grain in the form of a layered or non-layered structure. The halogen composition in the localized phase is preferably such that the silver bromide content therein is at least 10 mol% or more, more preferably more than 20 mol%. The localized phase may be in the inside of the grain or on the edges or corners of the surface of the grain. The localized phase may be on the corners of the grain as epitaxially grown phases in a preferred embodiment.

In the present invention, a silver chlorobromide or silver chloride which does not substantially contain silver iodide is preferably used. The description "... does not substantially contain silver iodide" referred to herein means that the silver iodide content in the silver halide is 1 mol% or less, preferably 0.2 mol% or less.

Regarding the halogen composition of grains of constituting an emulsion for use in the present invention, the grains may have different halogen compositions. Preferably, however, the emulsion contains grains each having the same halogen composition, since the property of the grains is easily rendered uniform. Regarding the halogen composition distribution of the grains of constituting a silver halide emulsion for use in the present invention, the grain may have a so-called uniform halogen composition structure where all of the grain has the same halogen composition; or the grain may have a so-called laminate (core/shell) structure where the halogen composition of the core of the grain is different from that of the shell of the same; or the grain may have a composite halogen composition structure where the inside or surface of the grain has a non-layered different halogen composition portion (for example, when such a nonlayered different halogen composition portion is on the surface of the grain, it may be on the edge, corner or plane of the grain as an integrated structure). Any halogen compositions may be appropriately selected. In order to obtain a high sensitivity photographic material, the latter laminate or composite halogen structure grains are advantageously employed, rather than uniform halogen composition structure grains. Such laminate or composite halogen composition structure grains are also preferred for preventing generation of stress marks. In the case of laminate or composite halogen composition structure grains, the boundary between the different halogen composition parts may be definite or may also be indefinite forming a mixed crystal structure because of the difference in the halogen compositions between the adjacent portions. If desired, the boundary between them may vary affirmatively.

The silver halide grains of the silver halide emulsion of the present invention may have a mean grain size of preferably from 0.1 μm to 2 μm, especially preferably from 0.15 μm to 1.5 μm. (The term "grain size" indicates the diameter of a circle having an area equivalent to the projected area of the grain, and the mean grain size indicates a number average value obtained from the measured grain sizes.) Regarding the grain size distribution of the emulsion, a so-called monodispersed emulsion having a coefficient of variation (obtained by dividing the standard deviation of the grain size distribution by the mean grain size) of 20% or less, preferably 15% or less is preferred. To obtain a broad latitude, two or more monodispersed emulsions may be blended to form a mixed emulsion for one layer, or they may be separately coated to form plural layers.

Regarding the shape of the silver halide grains of the silver halide emulsion of the present invention, the grains may be regular crystalline grains such as cubic, tetradeahedral or octahedral crystalline grains, or irregular crystalline grains such as spherical or tabular crystalline grains, or may be composite crystalline grains composed of such regular and irregular crystalline grains. They may also be tabular grains.

The silver halide emulsion for use in the present invention may be either a so-called surface latent image type emulsion forming a latent image predominately on the surface of the grain or a so-called internal latent image type emulsion forming a latent image essentially in the inside of the grain.

The silver halide photographic emulsion for use in the present invention can be produced by various known methods, for example, by the methods described in *Research Disclosure* (RD) No. 17643 (December, 1978), pages 22 to 23, "I. Emulsion Preparation and Types", ibid., No. 18716 (November, 1979), page 648; P. Glafkides, *Chemie et Phisique Photographique* (published by Paul Montel, 1967); F. Duffin, *Photographic Emulsion Chemistry* (published by Focal Press, 1966); and V.L. Zelikman et al., *Making and Coating Photographic Emulsion* (published by Focal Press, 1964).

Monodispersed emulsions prepared by the methods described in U.S. Pat. Nos. 3,574,628 and 3,655,394 and British Patent 1,413,748 are also preferably employed in the present invention.

Tabular grains having an aspect ratio of about 5 or more may also be employed in the present invention. These tabular grains may easily be prepared using known methods, for example, by the methods described in Gutoff, *Photographic Science and Engineering*, Vol. 14, pages 248 to 257 (1979); and U.S. Pat. Nos. 4,434,226, 4,414,310, 4,433,048 and 4,439,520 and British Patent 2,112,157.

Regarding the crystal structure of the silver halide grains for use in the present invention, the grains may have different halogen compositions in the inside of the grain and the surface portion thereof, or they may have a layered structure. They may be composed of different silver halide compositions bonded by epitaxial junctions. If desired, the silver halide grains may have a compound other than silver halides, such as silver rhodanide or lead oxide, bonded to the silver halide matrix by a junction.

A mixture comprising silver halide grains with different crystalline forms may also be used.

The silver halide emulsion for use in the present invention may generally be physically ripened, chemically ripened or spectrally sensitized.

Various polyvalent metal ion impurities may be introduced into the silver halide grains for use in the present invention, during the step of forming the grains or the step of physically ripening the grains. Examples of compounds usable for this purpose are salts of cadmium, zinc, lead, copper or thallium, as well as salts or complex salts of VIII Group elements such as iron, ruthenium, rhodium, palladium, osmium, iridium or platinum.

Additives usable in physical ripening, chemical ripening and spectral sensitizing steps applicable to the silver halide emulsions for use in the present invention are described in *Research Disclosure*, Nos. 17643, 18716 and 307105, and the relevant parts therein are mentioned below. Other known additives which may be used in the present invention are also described in these *Research Disclosure* references and the relevant parts therein are also mentioned below.

| Kind of Additive | RD 17643 | RD 18716 | RD 307105 |
|---|---|---|---|
| 1. Chemical Sensitizers | p. 23 | p. 648, right column | p. 866 |
| 2. Sensitivity Enhancers | | p. 648, right column | |
| 3. Spectral Sensitizers Supercolor Sensitizers | pp. 23 to 24 | p. 648, right column to p. 649, right column | pp. 866 to 868 |
| 4. Whitening Agents | p. 24 | p. 647, right column | p. 868 |
| 5. Anti-foggants Stabilizers | pp. 24 to 25 | p. 649, right column | pp. 868 to 870 |
| 6. Light-Absorbents Filter Dyes Ultraviolet Absorbents | pp. 25 to 26 | p. 649, right column to p. 650, left column | p. 873 |
| 7. Stain Inhibitors | p. 25, right column | p. 650, left to right column | p. 872 |
| 8. Color Image Stabilizers | p. 25 | p. 650, left column | p. 872 |
| 9. Hardening Agents | p. 26 | p. 651, left column | pp. 874 to 875 |
| 10. Binders | p. 26 | p. 651, left column | pp. 873 to 874 |
| 11. Plasticizers Lubricants | p. 27 | p. 650, right column | p. 876 |
| 12. Coating Aids Surfactants | pp. 26 to 27 | p. 650, right column | pp. 875 to 876 |
| 13. Antistatic Agents | p. 27 | p. 650, right column | pp. 876 to 877 |
| 14. Mat Agents | | | pp. 878 to 879 |

In order to prevent a deterioration in the photographic characteristics of the photographic material of the invention due to formaldehyde gas, compounds capable of reacting with formaldehyde to solidify it, for example, those described in U.S. Pat. Nos. 4,411,987 and 4,435,503, are preferably incorporated into the material.

Various color couplers can be incorporated into the photographic material of the present invention, and examples of suitable color couplers are described in patent publications referred to in the above-mentioned RD, No. 17643, VII-C to G and RD, No. 307105, VII-C to G.

Examples of preferred yellow couplers, for example, are those described in U.S. Pat. Nos. 3,933,501, 4,022,620, 4,326,024, 4,401,752, 4,248,961, JP-B-58-10739, British Patents 1,425,020, 1,476,760, U.S. Pat. Nos. 3,973,968, 4,314,023, 4,511,649, and European Patent 249,473A.

Above all, yellow couplers capable of forming dyes, which have a maximum absorption wavelength (absorption peak) in a short-wave range and have a sharply decreasing absorption in a long-wave range can be used with the couplers of formula (I) of the present invention, to achieve the color reproducibility of the combined couplers. Such yellow couplers are described in, for example, JP-A-63-123047 and 1-173499.

Preferred magenta couplers are 5-pyrazolone compounds and pyrazoloazole compounds and is contained in green-sensitive silver halide emulsion layer.

Especially preferred magenta couplers are pyrazoloazole magenta couplers.

Pyrazoloazole magenta couplers which are especially preferably used in the present invention are those of the general formula (M):

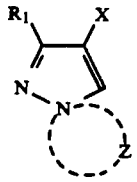

(M)

where $R_1$ represents a hydrogen atom or a substituent;

Z represents a non-metallic atomic group necessary for forming a 5-membered azole ring containing from 2 to 4 nitrogen atoms, and the azole ring may optionally have substituent(s) including condensed ring(s); and X represents a hydrogen atom or a group which may split off from the formula on coupling with an oxidation product of an aromatic primary amine developing agent.

Magenta couplers of the formula (M) are explained in detail hereunder.

In formula (M), the coupler skeleton is preferably 1H-imdazo[1,20b]pyrazole, 1H-pyrazolo[1,5-b]-[1,2,4]triazole, 1H-pyrazolo[5,1-c][1,2,4triazole or 1H-pyrazolo[1,5-d]tetrazole, which is represented by the following formula (M-I), (M-II), (M-III) or (M-IV).

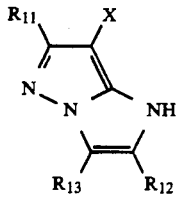

(M-I)

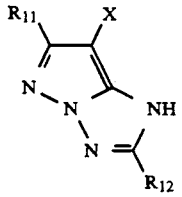

(M-II)

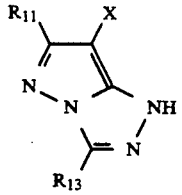

(M-III)

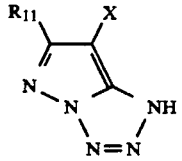

(M-IV)

$R_1$ and $R_{11}$ in the above formulae independently represent a hydrogen atom, a halogen atom, an alkyl group, an aryl group, a heterocyclic group, a cyano group, a hydroxyl group, a nitro group, a carboxyl group, an amino group, an alkoxy group, an aryloxy group, an acylamino group, an alkylamino group, an anilino group, an ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic-oxy group, an azo group, an acyloxy group, a carbamoyloxy group, a silyloxy group, an aryloxycarbonylamino group, an imido group, a heterocyclic-thio group, a sulfinyl group, a phosphonyl group, an aryloxycarbonyl group, an acyl group or an azolyl group; or $R_1$ and $R_{11}$ may be a divalent group forming a bis form compound.

More specifically, $R_1$ and $R_{11}$ independently represent a hydrogen atom, a halogen atom (e.g., chlorine, bromine), an alkyl group (e.g., a linear or branched alkyl, aralkyl, alkenyl, alkynyl, cycloalkyl or cycloalkenyl group having from 1 to 32 carbon atoms, such as methyl, ethyl, propyl, isopropyl, t-butyl, tridecyl, 2-methanesulfonylethyl, 3-(3-pentadecylphenoxy) propyl, 3-{4-{2-[4-(4-hydroxyphenylsulfonyl)-phenoxy]-dodecanamido}phenyl}propyl, 2-ethoxytridecyl, trifluoromethyl, cyclopentyl, 3-(2,4-di-t-amylphenoxy)propyl), an aryl group (e.g., phenyl, 4-t-butylphenyl, 2,4-di-t-amylphenyl, 4-tetradecanamidophenyl), a heterocyclic group (e.g., 2-furyl, 2-thienyl, 2-pyrimidinyl, 2-benzothiaozlyl), a cyano group, a hydroxyl group, a nitro group, a carboxyl group, an amino group, an alkoxy group (e.g., methoxy, ethoxy, 2-methoxyethoxy, 2-dodecyloxyethoxy, 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, 3-methoxycarbamoylphenoxy), an acylamino group (e.g., acetamido, benzamido, tetradecanamido, 2-(2,4-di-t-amylphenoxy) butanamido, 4-(3-t-butyl-4-hydroxyphenoxy)butanamido, 2-{4-(4-hydroxyphenylsulfonyl)phenoxy}decanamido), an alkylamino group (e.g., methylamino, butylamino, dodecylamino, diethylamino, methylbutylamino), an anilino group (e.g., phenylamino, 2-chloroanilino, 2-chloro-5-tetradecanaminoanilino, 2-chloro-5-dodecyloxycaronylanilino, N-acetylanilino, 2-chloro-5-{α-(3-t-butyl-4-hydroxyphenoxy}dodecanamido]anilino), an ureido group (e.g., phenylureido, methylureido, N,N-dibutylureido), a sulfamoylamino group (e.g., N,N-dipropylsulfamoylamino, N-methyl-N-decylsulfamoylamino), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 2-carboxyphenylthio, 4-tetradecanamidophenylthio), an alkoxycarbonylamino group (e.g., methoxycarbonylamino, tetradecyloxycarbonylamino), a sulfonamido group (e.g., methanesulfonamido, hexadecanesulfonamido, benzenesulfonamido, p-toluenesulfonamido, octadecanesulfonamido, 2-methyloxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-t-amylphenoxy)-propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (e.g., methanesulfonyl, octanesulfonyl, benzenesulfonyl, toluenesulfonyl), an alkoxycarbonyl group (e.g., methoxycarbonyl, butyloxycarbonyl, dodecyloxycarbonyl, octadecyloxycarbonyl), a heterocyclic-oxy group (e.g., 1-phenyltetrazol-5-oxy, 2-tetrahydropyranyloxy), an azo group (e.g., phenylazo, 4-methoxyphenylazo, 4-pivaloylaminophenylazo, 2-hydroxy-4-propanoylphenylazo), an acyloxy group (e.g., acetoxy), a carbamoyloxy group (e.g., N-methylcarbamoyloxy, N-phenylcarbamoyloxy), a silyloxy group (e.g., trimethylsilyloxy, dibutylmethylsilyloxy), an aryloxycarbonylamino group (e.g,. phenoxycarbonylamino), an imido group (e.g., N-succinimido, N-phthalimido, 3-octadecenylsuccinimido), a heterocyclic-thio group (e.g., 2-benzothiazolylthio, 2,4-di-phenoxy-1,3,5-triazole-6-thio, 2-pyridylthio), a sulfinyl group (e.g., dodecanesulfinyl, 3-pentadecylphenylsulfinyl, 3-phenoxypropylsulfinyl), a phosphonyl group (e.g., phenoxyphosphonyl, octyloxyphosphonyl, phenylphosphonyl), an aryloxycarbonyl group (e.g., phenoxycarbonyl), an acyl group (e.g., acetyl, 3-phenylpropanoyl, benzoyl, 4-dodecyloxybenzoyl), or an azolyl group (e.g., imidazolyl, pyrazolyl, 3-chloropyrazol-1-yl, triazolyl). These substituents may further be substituted with other substituents such as organic substituents or halogen atoms bonded thereto via a carbon, oxygen, nitrogen or sulfur atom.

Of the above-mentioned substituents for $R_1$ and $R_{11}$, an alkyl group, an aryl group, an alkoxy group, an aryloxy group, an alkylthio group, an ureido group, an urethane group and an acylamino group are preferred.

$R_{12}$ has the same meaning as $R_{11}$, and $R_{12}$ is preferably a hydrogen atom, an alkyl group, an aryl group, a heterocyclic group, an alkoxycarbonyl group, a carbamoyl group, a sulfamoyl group, a sulfinyl group, an acyl group, or a cyano group.

$R_{13}$ has the same meaning as $R_{11}$, and $R_{13}$ is preferably a hydrogen atom, an alkyl group, an aryl group, a heterocyclic group, an alkoxy group, an aryloxy group, an alkylthio group, an arylthio group, an alkoxycarbonyl group, a carbamoyl group, or an acyl group. More preferably, $R_{13}$ is an alkyl group, an aryl group, a heterocyclic group, an alkylthio group, or an arylthio group.

X represents a hydrogen atom or a group releasable from the formula on coupling with an oxidation product of an aromatic primary amine developing agent. The releasable group for X is more specifically a halogen atom, an alkoxy group, an aryloxy group, an acyloxy group, an alkyl- or aryl-sulfonyloxy group, an acylamino group, an alkyl- or aryl-sulfonamido group, an alkoxycarbonyloxy group, an aryloxycarbonyloxy group, an alkyl-, aryl- or heterocyclic-thio group, a carbamoylamino group, a 5-membered or 6-membered nitrogen-containing heterocyclic group, an imido group, or an arylazo group, which may optionally be substituted by substituent(s) selected from those described for $R_{11}$.

More precisely, the releasable group for X is a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy, ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), an acyloxy group (e.g., acetoxy, tetradecanoyloxy, benzoyloxy), an alkyl- or aryl-sulfonyloxy group (e.g., methanesulfonyloxy, toluenesulfonyloxy, an acylamino group (e.g., dichloroacetylamino, heptafluorobutyrylamino), an alkyl- or arylsulfonamido group (e.g., methanesulfonamino, trifluoromethanesulfonamino, p-toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an alkyl-, aryl- or heterocyclic-thio group (e.g., dodecylthio, 1-carboxydodecylthio, phenylthio, 2-butoxy-5-t-octylphenylthio, tetrazolylthio), a carbamoylamino group (e.g., N-methylcarbamoylamino, N-phenylcarbamoylamino), a 5-membered or 6-membered nitrogen-containing heterocyclic group (e.g., imidazolyl, pyrazolyl, triazolyl, tetrazolyl, 1,2-dihydro-2-oxo-1-pyridyl), an imido group (e.g., succinimido, hydantoinyl), or an arylazo group (e.g., phenylazo, 4-methoxyphenylazo). In addition, X may also be a releasable group bonded to the formula via a carbon atom. Examples of such releasable groups are residues of bis-type couplers obtained by condensation of 4-equivalent couplers with aldehydes or ketones. If desired, X can contain a photographically useful group such as a development inhibitor or a development accelerator. Preferably, X is a halogen atom, an alkoxy group, an aryloxy group, an alkyl- or aryl-thio group, or a 5-membered or 6-membered nitrogen-containing heterocyclic group bonded to the formula at the coupling active position via a nitrogen atom.

Specific examples of magenta couplers of formula (M) which can be used in the present invention are described below, but the present invention is not to be construed as being limited to these compounds.

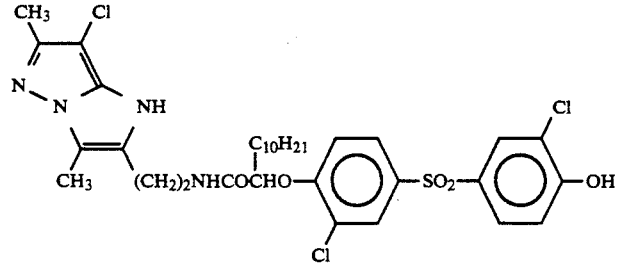

(M-1)

-continued
(M-2)
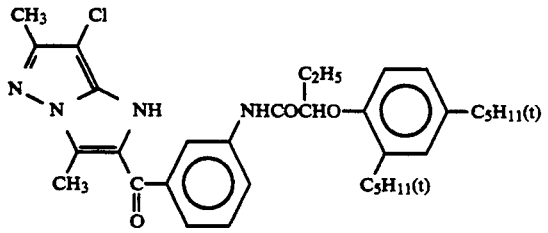
(M-3)
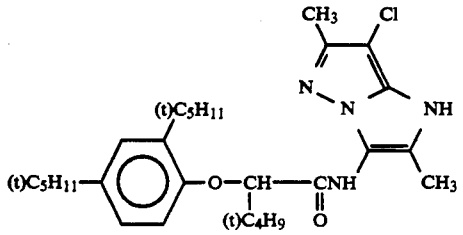
(M-4)
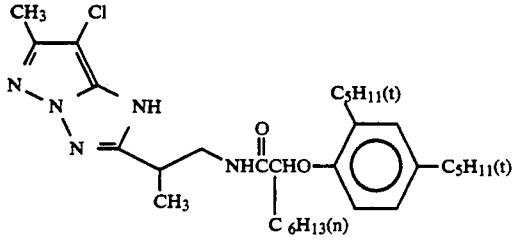
(M-5)
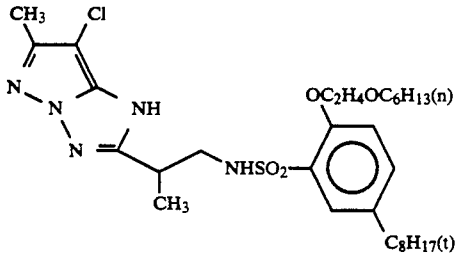
(M-6)
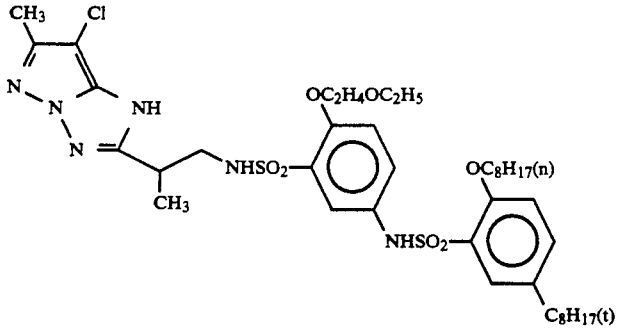
(M-7)
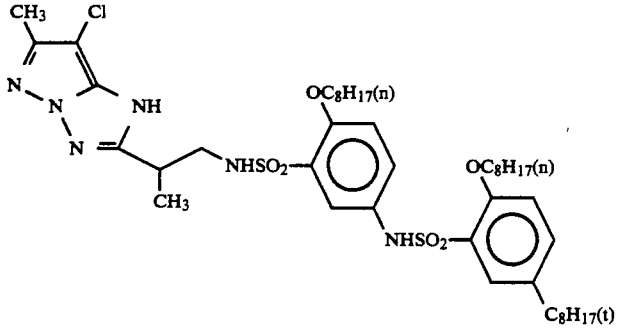

-continued
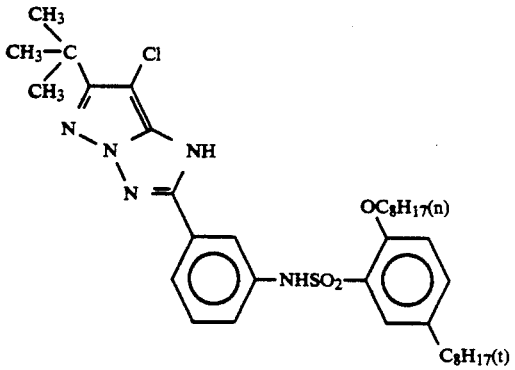
(M-8)
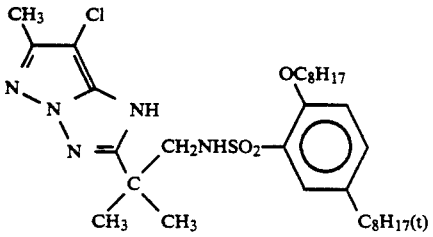
(M-9)
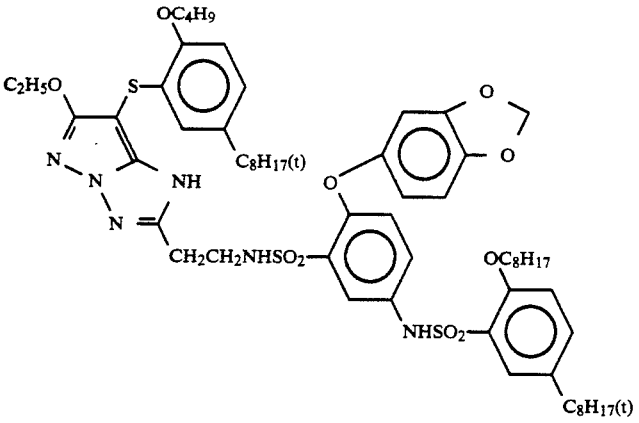
(M-10)
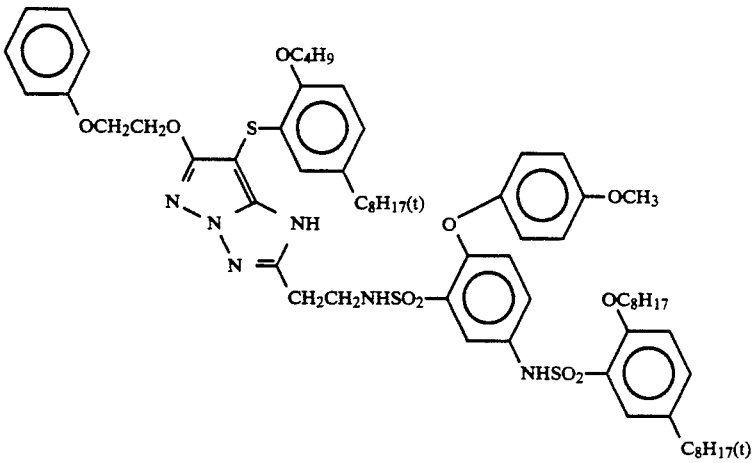
(M-11)

-continued
(M-12)
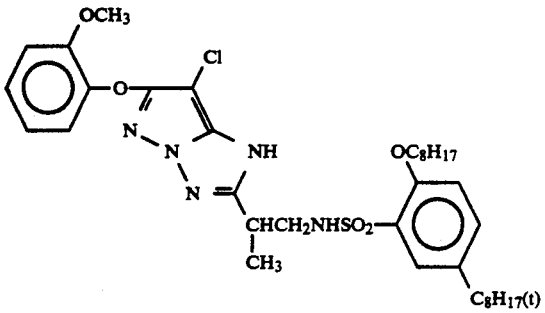
(M-13)
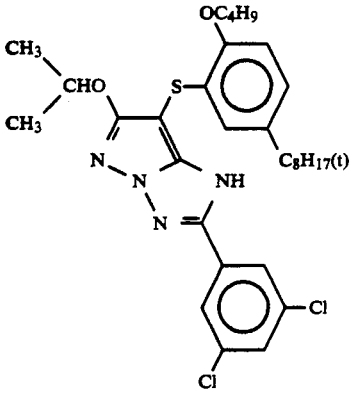
(M-14)
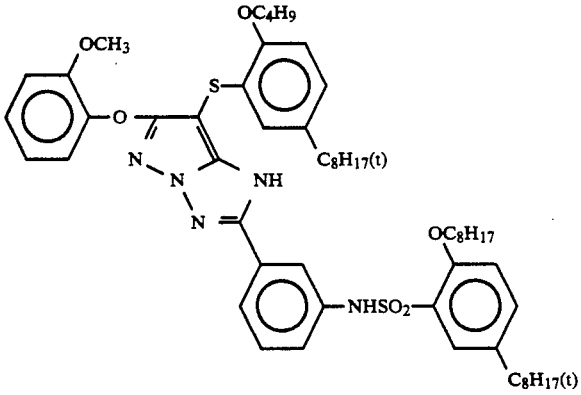
(M-15)
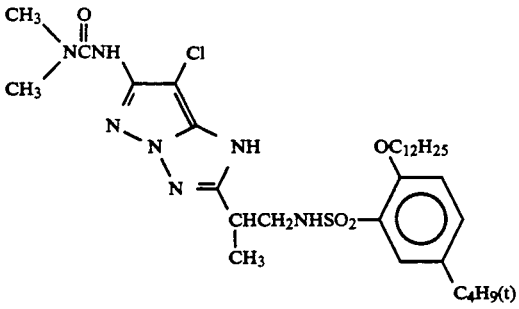
(M-16)
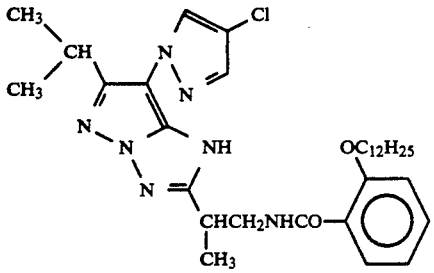

-continued
(M-17)
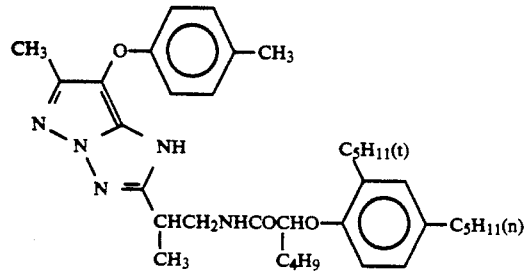
(M-18)
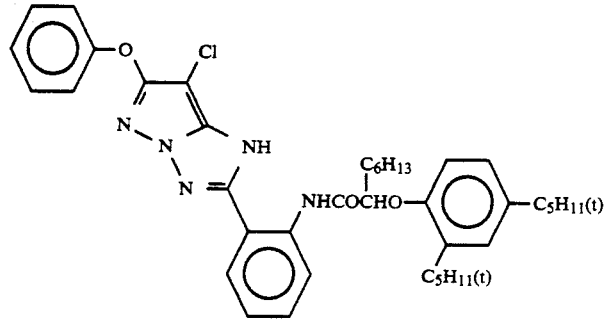
(M-19)
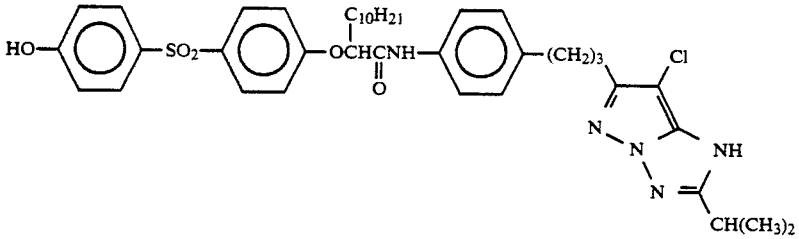
(M-20)
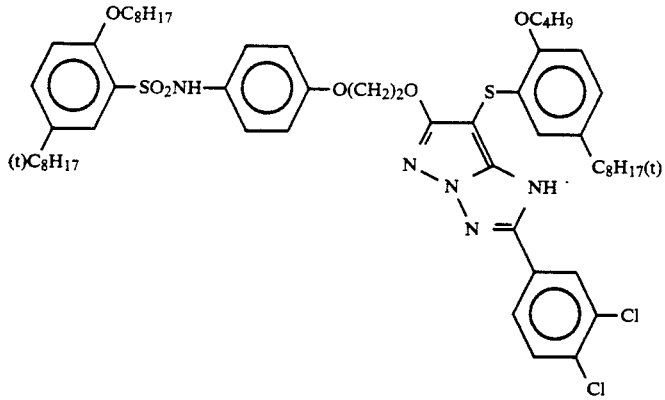
(M-21)
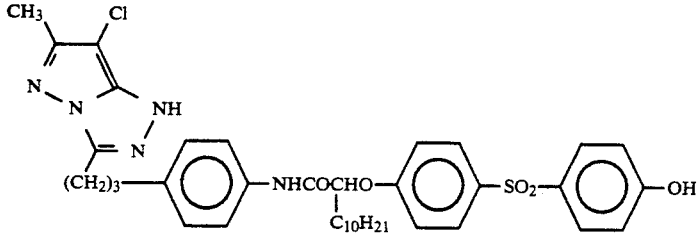

-continued
(M-22)
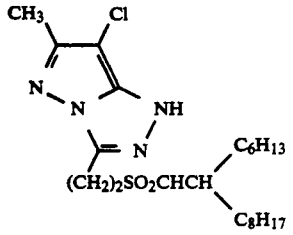
(M-23)
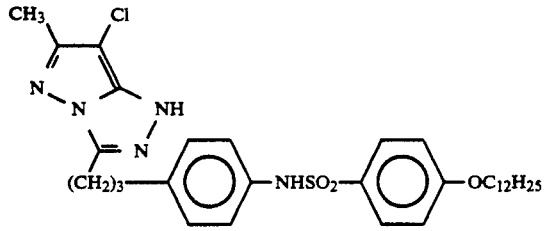
(M-24)
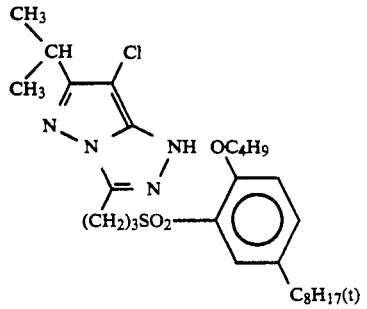
(M-25)
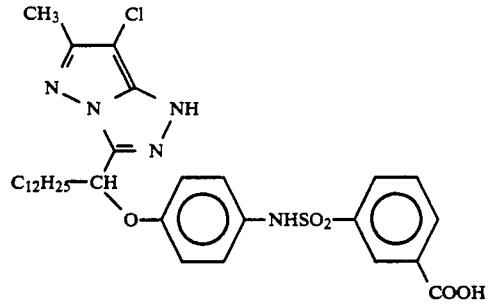
(M-26)
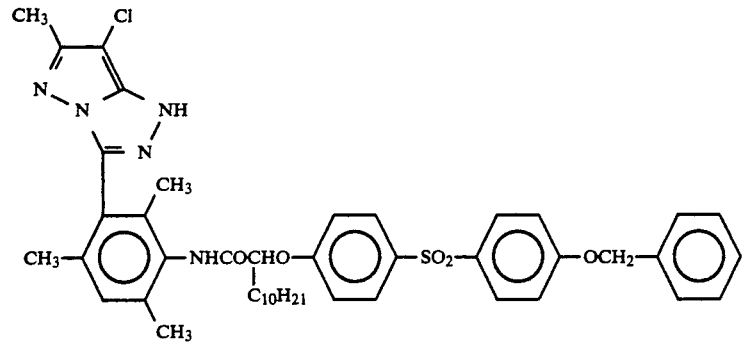

-continued (M-27)

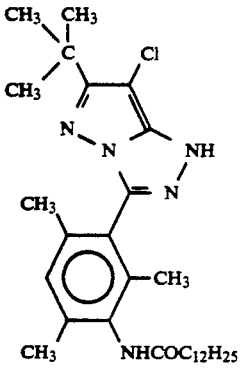

(M-28)

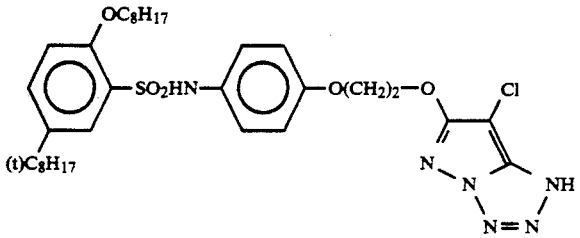

(M-29)

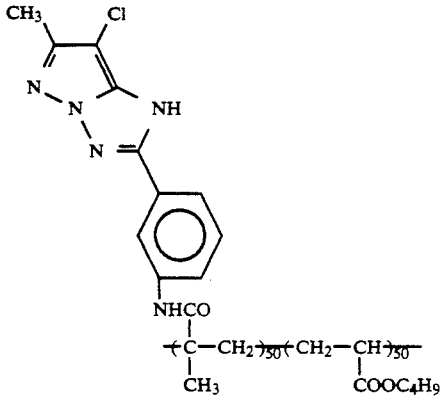

(M-30)

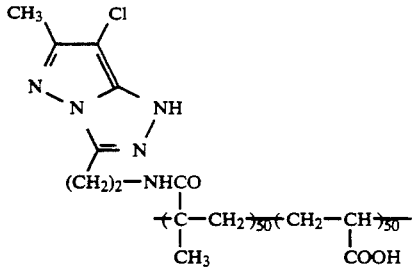

Couplers of formula (M) can be produced using known methods. For instance, compounds of formula (M-I) can be produced by the method described in U.S. Pat. No. 4,500,630; compounds of formula (M-II) can be produced by the methods described in U.S. Pat. Nos. 4,540,654 and 4,705,863, and JP-A-61-65245, 62-209457 and 62-249155; compounds of formula (M-III) can be produced by the methods described in JP-B-47-14711 and U.S. Pat. No. 3,725,067; and compounds of formula (M-IV) can be produced by the method described in JP-A-60-33552.

Typical preferred cyan couplers are phenol couplers and naphthol couplers For instance, those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, West German Patent (OLS) No. 3,329,729, European Patents 121,365A, 249,453A, U.S. Pat. Nos. 3,446,622, 4,333,999, 4,775,616, 4,451,559, 4,427,767, 4,690,889, 4,254,212, 4,296,199, and JP-A-61-42658 are preferred.

Colored couplers for correcting the unnecessary absorption of colored dyes may also be used in the present invention. Preferred examples of these colored couplers are those described in RD No. 17643, VII-G, U.S. Pat. No. 4,163,670, JP-B-57-39413, U.S. Pat. Nos. 4,004,929, 4,138,258, and British Patent 1,146,368. Additionally, couplers correcting the unnecessary absorption of the colored dyed by a phosphor dye released during coupling, as described in U.S. Pat. No. 4,774,181, as well as couplers with a dye precursor group capable of reacting with a developing agent to form a dyes, as a split-off group, as described in U.S. Pat. No. 4,777,120 are also preferably used.

Couplers capable of forming colored dyes with an appropriate diffusibility may also be used, and those described in U.S. Pat. No. 4,366,237, British Patent 2,125,570, European Patent 96,570,and West German Patent OLS No. 3,234,533 are preferred.

Polymer dye-forming couplers may also be used, and typical examples of such couplers are described in U.S. Pat. Nos. 3,451,820, 4,080,211, 4,367,282, 4,409,320, 4,576,910, and British Patent 2,102,173.

Couplers capable of releasing a photographically useful residue on coupling may also be used in the present invention. For instance, preferred DIR couplers of releasing a development inhibitor include those described in the patent publications as referred to in the above-mentioned RD, No. 17643, Item VII-F, as well as those described in JP-A-57-151944, 57-154234, 60-184248 and 63-37346, and U.S. Pat. Nos. 4,248,962 a 4,782,012 are preferred.

Preferred couplers imagewise releasing a nucleating agent or development accelerator during development are those described in British Patents 2,097,140 and 2,131,188, and JP-A-59-157638 and 59-170840.

Additionally, examples of other couplers which may be incorporated into the photographic materials of the present invention include competing couplers described in U.S. Pat. No. 4,130,427; poly-valent couplers described in U.S. Pat. Nos. 4,283,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and 62-24252; couplers releasing a dye which recolors after release from the coupler, as described in European Patent 173,302A; bleaching accelerator-releasing couplers as described in RD, Nos. 11449 and 24241, and JP-A-61-201247; ligand-releasing couplers described in U.S. Pat. No. 4,553,477; leuco dye-releasing couplers described in JP-A-63-75747; and couplers releasing a phosphor dye as described in U.S. Pat. No. 4,774,181.

The amount of couplers which may be used together with the coupler of formula (I) of the present invention is generally within the range of from 0.001 to 1 mol per mol of silver halide. Preferably, it is from 0.01 to 0.5 mol for yellow couplers; from 0.003 to 0.3 mol for magenta couplers; and from 0.002 to 0.3 mol for cyan couplers.

These additional couplers may be incorporated into the photographic material of the present invention using various known dispersion methods as described above.

The photographic material of the present invention may further contain hydroquinone derivatives, aminophenol derivatives, gallic acid derivatives and ascorbic acid derivatives, as a color fogging inhibitor.

The photographic material of the present invention may also contain various anti-fading agents. Typical organic anti-fading agents for cyan, magenta and/or yellow images usable in the present invention are hindered phenols such as hydroquinones, 6-hydroxychromans, 5-hydroxycoumarans, spirochromans, p-alkoxyphenols and bisphenols, and gallic acid derivatives, methylenedioxybenzenes, aminophenols, hindered amines and ether or ester derivatives formed by silylating or alkylating the phenolic hydroxyl group of the compounds. In addition, metal complexes such as (bis-salicylaldoximato)nickel complexes and (bis-N,N-dialkyldithiocarbamato)nickel complexes may also be used.

Specific examples of organic anti-fading agents usable in the present invention are hydroquinones described in U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801 and 2,816,028; 6-hydroxychromans, 5-hydroxychromans and spirochromans described in U.S. Pat. Nos. 3,432,300, 3,573,050, 3,574,627, 3,698,909 and 3,764,337, and JP-A-52-152225; spiroindanes described in U.S. Pat. No. 4,360,589; p-alkoxyphenols described in U.S. Pat. No. 2,735,765, British Patent 2,066,975, JP-A-59-10539, and JP-B-57-19765; hindered phenols described in U.S. Pat. Nos. 3,700,455 and 4,228,235, JP-A-52-72224, and JP-B-52-6623; gallic acid derivatives described in U.S. Pat. No. 3,457,079; methylenedioxybenzenes described in U.S. Pat. No. 4,332,886; aminophenols described in JP-B-56 21144; hindered amines described in U.S. Pat. Nos. 3,336,135 and 4,268,593, British Patents 1,326,889, 1,354,313 and 1,410,846, JP-B-51-1420, and JP-A-58-114036, 59-53846 and 59-78344; and metal complexes described in U.S. Pat. Nos. 4,050,938 and 4,241,155, and British Patent 2,027,731(A). The compounds are incorporated into the light-sensitive layers by co-emulsifying them with the corresponding color couplers generally in an amount of from 5 to 100% by weight to the coupler, whereby the function provided is attained. For the purpose of preventing cyan color images from fading by heat and especially by light, incorporation of an ultraviolet absorbent into the cyan coloring layer and both adjacent layers is effective.

Examples of ultraviolet absorbents usable for the purpose are aryl group-substituted benzotriazole compounds (for example, those described in U.S. Pat. Nos. 3,533,794), 4-thiazolidones (for example, those described in U.S. Pat. Nos. 3,314,794 and 3,352,681), benzophenone compounds (for example, those described in JP-A-46-2784), cinnamate compounds (for example, those described in U.S. Pat. Nos. 3,705,805 and 3,707,395), butadiene compounds (for example, those described in U.S. Pat. No. 4,045,229), and benzoxazole compounds (for example, those described in U.S. Pat. Nos. 3,406,070 and 4,271,307). Ultraviolet absorbing couplers (for example, α-naphthol cyan dye forming couplers) and ultraviolet absorbing polymers may also be used. These ultraviolet absorbents may be mordanted in particular layers.

Above all, aryl group-substituted benzotriazole compounds are preferred.

Gelatin is advantageously used as a binder or protective colloid in the emulsion layers of the photographic material of the present invention. Other hydrophilic colloids may also be used alone or with gelatin.

The gelatin for use in the present invention may be either a lime-processed gelatin or an acid-processed gelatin. These gelatins and their production are described in Arther Vais, *The Molecular Chemistry of Gelatin* (published by Academic Press, 1964).

The photographic material of the present invention can contain various antiseptics and fungicides, such as 1,2-benzisothiazolin-3-one, n-butyl p-hydroxybenzoate, phenol, 4-chloro-3,5-dimethylphenol, 2-phenoxyethanol, and 2-(4-thiazolyl)benzimidazole, as described in JP-A-63-257747, 62-272248 and 1-80941.

Where the photographic material of the present invention is a direct positive color photographic material, it may contain a nucleating agent, such as hydrazine compounds or quaternary heterocyclic compounds as described in *Research Disclosure* No. 22534 (January, 1983), as well as a nucleation accelerator for promoting the effect of the nucleating agent.

Examples of supports which can be used in the photographic material of the present invention are a transparent film such as cellulose nitrate film or polyethylene terephthalate film, or a reflective support, which is generally used in preparing conventional photographic materials, can be used. In view of the object of the present invention, a reflective support is more preferred.

A "reflective support" which is advantageously used in the present invention is a support capable of increasing the reflectivity of the photographic material to thereby enhance the sharpness of the color image formed in the silver halide emulsion layer. Examples of reflective supports include those prepared by coating a hydrophobic resin containing a photo-reflecting substance, such as titanium oxide, zinc oxide, calcium carbonate or calcium sulfate, dispersed therein, on a support base; and those formed from a hydrophobic resin containing the above-mentioned photo-reflective substance dispersed therein. For instance, specific examples are baryta paper; polyethylene-coated paper; polypropylene synthetic paper; and transparent supports (such as glass plates, polyester films such as polyethylene terephthalate, cellulose triacetate or cellulose nitrate film, polyamide films, polycarbonate films, polystyrene films, and vinyl chloride resin films coated with a reflective layer or containing a reflective substance.

The photographic material of the present invention may be processed in accordance with conventional photographic processing methods, for example, by the methods described in the *Research Disclosure,* No. 17643, pages 28 to 29 and ibid., No. 18716, page 615, from left to right column. For instance, the material can be subjected to a color development comprising a color developing step, a desilvering step and a rinsing step. Where the material is subjected to a reversal development, the process comprises a black-and-white developing step, a rinsing step, a reversal step and a color developing step. In the desilvering step, bleaching with a bleaching solution and fixing with a fixing solution are accomplished. A combined bleach-fixing with a bleach-fixing solution may also be used. The bleaching step, the fixing step and the bleach-fixing step may be conducted in any desired order. A stabilization may be used in place of rinsing. If desired, the photographic material may be processed with a mono-bath process using a mono-bath developing and bleach-fixing solution where color development, bleaching and fixation are effected in one bath. Anyone of a pre-hardening step, a neutralization step, a stopping and fixing step, a post-hardening step, an adjusting step and an intensifying step may be carried out as a combination of processing steps. Between these steps, any desired inter-rinsing step may be carried out. In place of the color development step, a so-called activator processing step may also be conducted.

The color developer to be used for developing the photographic material of the present invention is an aqueous alkaline solution containing an aromatic primary amine color developing agent as a main component. Examples of useful color developing agents are aminophenol compounds but p-phenylenediamine compounds are more preferably used. Specific examples of these compounds are 3-methyl-4-amino-N,N-diethylaniline, 3-methyl-4-amino-N-ethyl-N-β-hydroxyethylaniline, 4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylanilne, and sulfates, hydrochlorides and p-toluenesulfonates of these compounds. These compounds may be used alone or as a combination of two or more thereof depending on the object desired.

The color developer generally contains a pH buffer such as alkali metal carbonates, borates or phosphates; and a development inhibitor or an antifoggant such as chlorides, bromides, iodides, benzimidazoles, benzothiazoles or mercapto compounds. If desired, it may also contain various preservatives, such as hydroxylamine, diethylhydroxylamine, sulfites, hydrazines (e.g., N,N-biscarboxymethylhydrazine), phenylsemicarbazides, triethanolamine, and catechol-sulfonic acids; organic solvents such as ethylene glycol or diethylene glycol; development accelerators such as benzyl alcohol, polyethylene glycol, quaternary ammonium salts or amnes; dye forming couplers; competing couplers; auxiliary developing agents such as 1-phenyl-3-pyrazolidone; nucleating agents such as sodium borohydride or hydrazine compounds; tackifiers; various chelating agents such as aminopolycarboxylic acids, aminopolyphosphonic acids, alkylphosphonic acids or phosphonocarboxylic acids (e.g., ethylenediamine-tetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts thereof); brightening agents such as 4,4'-diamino-2,2'-disulfostilbene compounds; and various surfactants such as alkylsulfonic acids, arylsulfonic acids, aliphatic carboxylic acids and aromatic carboxylic acids.

The color developer for use in the present invention preferably does not contain substantially any benzyl alcohol. The color developer not containing substantially any benzyl alcohol is a developer containing benzyl alcohol preferably in an amount of 2 ml/liter or less, more preferably 0.5 ml/liter or less, most preferably one containing no benzyl alcohol.

The color developer for use in the present invention also preferably does not contain substantially any sulfite ion. The color developer not containing substantially any sulfite ion is one containing sulfite ion preferably in an amount of $3.0\times10^{-3}$ mol/liter or less, more preferably one containing no sulfite ion.

The color developer for use in the present invention further does not contain substantially any hydroxylamine. The color developer not containing substantially any hydroxylamine is one containing hydroxylamine preferably in an amount of $5.0\times10^{-3}$ mol/liter or less, more preferably one containing no hydroxylamine. The color developer for use in the present invention advantageously contains an organic preservative (for example, hydroxylamine derivatives or hydrazine derivatives), other than hydroxylamine.

The color developer generally has a pH of from 9 to 12.

The color reversal process which can be applied to the photographic material of the present invention generally comprises a black-and-white processing step, a rinsing step, a reversal processing step and a color development step. The reversal processing step may use a reversal bath containing a foggant or may be effected using a photo-reversal treatment. If desired, such a foggant may be incorporated into a color developer and the reversal processing step can be omitted.

The black-and-white developer to be used in the black-and-white processing step may be any conventional developer usable for processing conventional black-and-white photographic materials, and it may contain additives generally applicable to conventional black-and-white developers.

Typical additives include developing agents such as 1-phenyl-3-pyrazolidone, N-methyl-p-aminophenol and hydroquinone; preservatives such as sulfites; pH buffers of water-soluble acids such as acetic acid or boric acid; pH buffers or development accelerators comprising water-soluble alkalis such as sodium hydroxide, sodium carbonate or potassium carbonate; inorganic or organic development inhibitors such as potassium bromide, 2-methylbenzimidazole or methylbenzothiazole; water softeners such as ethylenediaminetetraacetic acid or polyphosphates; antioxidants such as ascorbic acid or diethanolamine; organic solvents such as triethylene glycol or cellosolves; and surface overdevelopment inhibitors such as a slight amount of iodides or mercapto compounds.

Where the amount of replenisher to such a developer is reduced, it is desired for evaporation or aerial oxidation of the processing solution to be prevented by reducing the contact area between the surface of the processing tank and air. Methods of reducing the contact area between the surface of the processing tank and air include a surface-masking substance such as a floating lid on the surface of the processing solution in the processing tank. It is preferred for this technique to be employed not only in both of the color development and black-and-white development steps but also in all of the successive steps. In addition, a recovery means to prevent accumulation of bromide ions in the developer tank may also be employed to reduce the amount of replenisher to be added to the tank.

The color development time is generally between 2 minutes and 5 minutes. However, by elevating the processing temperature and elevating the pH of the processing solution (developer) and further elevating the concentration of the color developing agent in the developer, the processing time (color development time) may be shortened further.

The photographic emulsion layer is, after color-development, desilvered. Desilvering is effected by simultaneous or separate bleaching and fixation. Bleach-fixation comprising simultaneous bleaching and fixation can be used. In order to further accelerate the processing, bleach-fixation may be effected after bleaching. If desired, a bleaching bath comprising two tanks connected in series may be used; or fixation may be effected before bleach-fixation; or bleach-fixation may be effected after bleaching. The processing systems may be selected and employed depending on the object desired. In processing the photographic material of the present invention, it is advantageous for the material to be color-developed and then immediately bleach-fixed to more efficiently achieve the effect of the present invention.

Bleaching agents which can be used in the bleaching solution or bleach-fixing solution usable in the present invention are compounds of polyvalent metals such as iron(III); per acids; quinones; and iron salts. Specific examples of these agents are iron chloride; ferricyanides; bichromates; organic complexes of iron(III) (for example, metal complexes of aminopolycarboxylic acids such as ethylenediaminetetraacetic acid, diethylenetriaminepentaacetic acid, 1,3-diaminopropanetetraacetic acid); and persulfates. Above all, aminopolycarboxylato/iron(III) complexes are preferred to efficiently achieve the effect of the present invention. Aminopolycarboxylato/iron(III) complexes are useful both in a bleaching solution and especially in a bleach-fixing solution. The bleaching solution or bleach-fixing solution containing such an aminopolycarboxylato/iron(III) complex is used under the condition of a pH of from 3.5 to 8.

The bleaching solution or bleach-fixing solution may contain various known additives, for example, a rehalogenating agent such as ammonium bromide or ammonium chloride; a pH buffer such as ammonium nitrate; and a metal corrosion inhibitor such as ammonium sulfate.

The bleaching solution or bleach-fixing solution preferably contains an organic acid for the purpose of preventing bleaching stains, in addition to the abovedescribed compounds. Especially preferred organic acids for this purpose are compounds having an acid dissociation constant (pKa) of from 2 to 5.5. Acetic acid and propionic acid are preferred.

Examples of fixing agents to be in the fixing solution or bleach-fixing solution to be used in the present invention are thiosulfates, thiocyanates, thioether compounds, thioureas, and a large amount of iodides. Thiosulfates are generally used. In particular, ammonium thiosulfate is most widely used. In addition, a combination of thiosulfates and thiocyanates, thioether compounds or thioureas can also be advantageously used.

The fixing solution of the bleach-fixing solution may contain a preservative such as sulfites, bisulfites, carbonyl-bisulfite adducts, or sulfinic acid compounds described in European Patent 294,769A. In addition, it is preferred to add various aminopolycarboxylic acids or organic phosphonic acids (e.g., 1-hydroxyethylidene-1,1-diphosphonic acid, N,N,N',N'-ethylenediaminetetraphosphonic acid) to the fixing solution or bleach-fixing solution for the purpose of stabilizing the solution.

The fixing solution or bleach-fixing solution may further contain various brightening agents, defoaming agents, surfactants, polyvinyl pyrrolidone and methanol.

The bleaching solution and bleach-fixing solution and the pre-bath thereof may optionally contain a bleaching accelerator. Specific examples of usable bleaching accelerators are compounds having a mercapto group or disulfido group as described in U.S. Pat. No. 3,893,858, German Patents 1,290,812 and 2,059,988, JP-A-53-32736, 53-57831, 53-37418, 53-72623, 53-95631, 53-104232, 53-124424, 53-141623 and 53-28426, and *Research Disclosure*, No. 17129 (July, 1978); thiazolidine derivatives described in JP-A-50-140129; thiourea derivatives described in JP-B-45-8506, JP-A-52-20832 and 53-32735, and U.S. Pat. No. 3,706,561; iodides described in German Patent 1,127,715, and JP-A-58-16235; polyoxyethylene compounds described in German Patents 966,410 and 2,748,430; polyamine compounds described in JP-B-45-8836; compounds described in JP-A-49-42434, 49-59644, 53-94927, 54-35727, 55-26506 and bromide ions. Above all, compounds having a mercapto group or disulfido group are preferred because of a large accelerating effect, and in particular, those described in U.S. Pat. No. 3,893,858, German Patent 1,290,812 and JP-A-53-95630 are especially preferred.

In addition, the compounds described in U.S. Pat. No. 4,552,834 are also preferred. Such a bleaching accelerator may be added to the photographic material. Where the photographic material of the present invention is a picture-taking color photographic material and it is bleach-fixed, the above-described bleaching accelerators are especially effective.

The total desilvering time preferably should be as short as possible within the range that desilvering is achieved. The preferred time is from one minute to 3 minutes. The processing temperature may be between 25° C. and 50° C., preferably between 35° C. and 45° C.

In the desilvering step, it is desired to enhance the degree of stirring as much as possible. Specific means for accelerating the stirring are a method of jetting a stream of the processing solution against the emulsion-coated surface of the photographic material being processed, as described in JP-A-62-183460. This stirring acceleration means is effective also in processing steps involving a bleaching solution, a bleach-fixing solution and a fixing solution.

The photographic material of the present invention is generally rinsed, after being desilvered as mentioned above. Stabilization may also be conducted in place of rinsing. In the stabilization step, any known methods as described, for example, in JP-A-57-8543, 58-14834 and 60-220345 may be employed. If desired, a combined rinsing-stabilization step may be effected, in which a stabilizing bath containing a dye-stabilizing agent and a surfactant is used as the final bath. The step is conveniently applied to picture-taking color photographic materials.

The rinsing solution and stabilizing solution applicable to the photographic material of the present invention may contain a water softener such as inorganic phosphoric acids, polyaminocarboxylic acids or organic aminophosphonic acids; microbiocide such as isothiazolone compounds or thiabendazoles, or a chlorine-containing microbiocide such as sodium chloroisocyanurate; a metal salt such as magnesium salts, aluminum salts or bismuth salts; a surfactant; a hardening agent; and a bactericide.

The amount of the rinsing water to be used in the rinsing step may be set in a broad range, depending upon the properties of the photographic material being processed (for example, the components of the material, such as couplers, etc.), the use of the material, the temperature of the rinsing water, the number of rinsing tanks (the number of rinsing stages), the replenishment system (either countercurrent type or normal current type), and other various conditions. The relationship between the number of rinsing tanks and the rinsing water in a multi-stage countercurrent rinsing system may be obtained in accordance with the method described in *Journal of the Society of Motion Picture and Television Engineers*, Vol. 64, pages 248 to 253 (May, 1955). The method of reducing the amounts of calcium ions and magnesium ions in the rinsing water, as described in JP-A-62-288838, may be used extremely effectively.

The rinsing water has a pH of from 4 to 9, preferably from 5 to 8, The temperature of the rinsing water and the rinsing time may also be varied, depending upon the properties and the uses of the photographic material being processed. In general, the rinsing temperature is from 15° C. to 45° C. and the rinsing time is from 20 seconds to 10 minutes; preferably, the former is from 25° C. to 40° C. and the latter is from 30 seconds to 5 minutes.

Examples of dye stabilizing agents which may be used in the stabilizing solution are aldehydes such as formaldehyde and glutaraldehyde; N-methylol compounds such as dimethylolurea; hexamethylenetetramine; and aldehyde-sulfite adducts. The stabilizer may further contain a pH adjusting buffer such as boric acid or sodium hydroxide; a chelating agent such as 1-hydroxyethylidene-1,1-diphosphonic acid or ethylenediaminetetraacetic acid; an antioxidant such as alkanolamines; a brightening agent; and a fungicide.

The overflow liquid due to replenishment of the above-mentioned rinsing solution and/or the stabilizing solution may be re-circulated to the other bath such as a previous desilvering bath.

The photographic material of the present invention can contain a color developing agent for the purpose of simply and rapidly processing the material. Preferably, various precursors of color developing materials are incorporated into the material. For instance, examples of usable precursors are indoaniline compounds described in U.S. Pat. No. 3,342,597, Schiff base compounds described in U.S. Pat. No. 3,342,599, *Research Disclosure* No. 14850 and ibid., No. 15159, aldol compounds described in *Research Disclosure*, No. 13924, metal complexes described in U.S. Pat. No. 3,719,492, and urethane compounds described in JP-A-53-135628.

The photographic material of the present invention may contain, if desired, various 1-phenyl-3-pyrazolidones for the purpose of promoting the color developability thereof. Specific examples of compounds usable for the purpose are described in JP-A-56-64339, 57-144547 and 58-115438.

In processing the photographic material of the present invention, the processing solutions are used at a temperature between 10° C. and 50° C. In general, the standard processing temperature is between 33° C. and 38° C. The processing temperature may be increased to promote the processing step or to shorten the processing time or it may be decreased to improve the image quality of the image to be formed or to promote the stability of the processing solutions being used.

The present invention is explained in greater detail by reference to the following examples, which, however, are not to be construed as limiting the scope of the present invention.

EXAMPLE 1

Preparation of Sample No. 101

Two layers as described below were formed on a cellulose triacetate film support to prepare a photographic material sample (Sample No. 101). The coating composition for the first layer was prepared as described below.

Preparation of Coating Composition for First Layer 1.01 g of Cyan Coupler (A-1) and 1.0 g of dibutyl phthalate were completely dissolved in 10.0 cc of ethyl acetate.

Cyan Coupler (A-1):

-continued

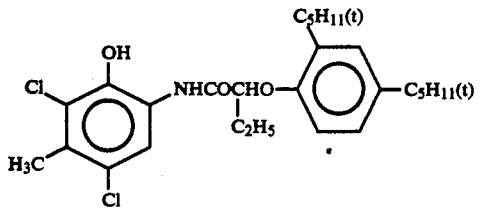

The ethyl acetate solution of the coupler was added to 42 g of an aqueous 10% gelatin solution (containing 5 g/liter of sodium dodecylbenzenesulfonate) and dispersed by emulsification using a homogenizer. After dispersion and emulsification, distilled water was added to the resulting dispersion to make the total 100 g. 100 G of the dispersion and 8.2 g of a red-sensitive high silver chloride emulsion (having a silver bromide content of 0.5 mol%, and containing $1.0\times10^{-4}$ mol per mol of silver halide of the following red-sensitizing dye) were blended to prepare a coating composition for the First Layer, which contained the components described below. 1-Hydroxy-3,5-dichloro-s-triazine sodium salt was used as a gelatin hardening agent.

Sensitizing Dye for Red-sensitive Emulsion:

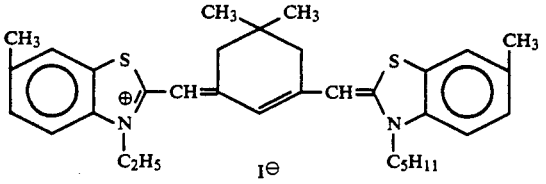

Layer Constitution

The layers contained the components described below.

| | |
|---|---|
| Support: | |
| Cellulose Triacetate Film | |
| First Layer (Emulsion Layer): | |
| Silver Chloride Emulsion | 0.32 g/m$^2$ as Ag |
| Gelatin | 2.50 g/m$^2$ |
| Cyan Coupler (A-1) | 0.45 g/m$^2$ |
| Dioctyl Phthalate | 1.05 g/m$^2$ |
| Second Layer (Protective Layer): | |
| Gelatin | 1.60 g/m$^2$ |

Preparation of Samples Nos. 102 to 106

Samples Nos. 102 to 106 were prepared in the same manner as Sample 101, except that Cyan Coupler (A-1) in Sample No. 101 was replaced by the same molar amount of the coupler as shown in Table 1 below.

Samples Nos. 101 to 106 thus prepared were wedgewise exposed to white light and then processed in accordance with the process described below.

Evaluation of Color Hue

The color absorption of the maximum density part of the processed sample was measured. The side absorption and the sharpness of the toe in the short-wave side were determined in accordance with the following formulae. From the values obtained, the color hue of the processed sample was evaluated.

Side Absorption = (Absorption Density at 420 nm)/(Absorption Density at Maximum Absorption Wavelength)

Sharpness of Toe in Short-wave Side = (Absorption Density at 550 nm)/(Absorption Density at Maximum Absorption Wavelength)

The results obtained are shown in Table 1 below.

Evaluation of Image Fastness

The processed samples were subjected to a fading test by exposure to xenon light for 15 days. After the fading test, the cyan density ($D_R$) of the part having a cyan density of 1.5 before the test was measured, and the color retention percentage was obtained from the following formula. The image fastness was evaluated on the basis of the values obtained. The results obtained are shown in Table 1 below.

Color Retention Percentage = $\{(D_R)/1.0\}\times100$

| Processing Step | Temperature | Time |
|---|---|---|
| Color Development | 38° C. | 45 sec |
| Bleach-Fixation | 35° C. | 45 sec |
| Rinsing (1) | 35° C. | 30 sec |
| Rinsing (2) | 35° C. | 30 sec |
| Rinsing (3) | 35° C. | 30 sec |
| Drying | 80° C. | 60 sec |

(Rinsing was effected using a 3-tank counter flow system from (3) to (1).)

The processing solutions used had the following compositions.

| | |
|---|---|
| Color Developer: | |
| Water | 800 ml |
| Ethylenediamine-N,N,N,N-tetramethylenephosphonic Acid | 3.0 g |
| Triethanolamine | 8.0 g |
| Potassium Chloride | 3.1 g |
| Potassium Bromide | 0.015 g |
| Patassium Carbonate | 25 g |
| Hydrazinodiacetic Acid | 5.0 g |
| N-Ethyl-N-(β-methanesulfonamidoethyl)-3-methyl-4-aminoaniline Sulfate | 5.0 g |
| Brightening Agent (WHITEX-4, product by Sumitomo) | 2.0 g |
| Water to make | 1000 ml |
| pH (with potassium hydroxide) | 10.05 |
| Bleach-fixing Solution: | |
| Water | 400 ml |
| Ammonium Thiosulfate Solution (700 g/liter) | 100 ml |
| Ammonium Sulfite | 45 g |
| Ammonium Ethylenediaminetetraacetato/Iron(III) | 55 g |
| Ethylenediaminetetraacetic Acid | 3 g |
| Ammonium Bromide | 30 g |
| Nitric Acid (67%) | 27 g |
| Water to make | 1000 ml |
| pH | 5.8 |

Rinsing Solution

Ion-exchanged Water (with calcium and magnesium contents of each 3 ppm or less).

Comparative Coupler (A-II):

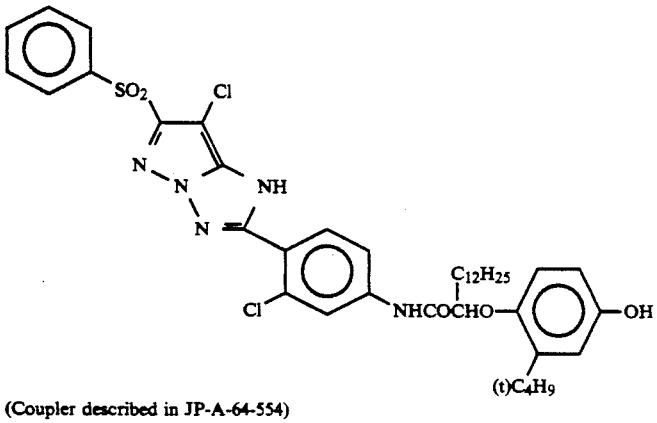

(Coupler described in JP-A-64-554)

TABLE 1

| Sample No. | Coupler | Side Absorption(*) | Sharpness of Toe in Short-wave Side(*) | λmax | Light Fastness | Remarks |
|---|---|---|---|---|---|---|
| 101 | A-1 | 1.00 | 1.00 | 644 nm | 79% | Comparative Sample |
| 102 | (A-II) | 0.82 | 0.81 | 601 nm | 62% | Comparative Sample |
| 103 | Coupler (1) | 0.62 | 0.71 | 641 nm | 95% | Sample of Invention |
| 104 | Coupler (2) | 0.59 | 0.69 | 615 nm | 94% | Sample of Invention |
| 105 | Coupler (7) | 0.49 | 0.68 | 635 nm | 94% | Sample of Invention |
| 106 | Coupler (15) | 0.52 | 0.67 | 610 nm | 93% | Sample of Invention |

(*)Relative Value to the value of Sample No. 101.

From the results in Table 1 above, it can be seen that the couplers of formula (I) of the present invention are suitable as a cyan coupler considering the value of $\lambda_{max}$ and they have excellent absorption characteristics with a small side absorption and with a sharp toe in the short-wave side. The cyan couplers of formula (I) have an improved color reproducibility especially with respect to green color reproducibility.

In addition, the dyes formed from the cyan couplers of formula (I) have an excellent light fastness.

EXAMPLE 2

Samples Nos. 201 to 206 were prepared in the same manner as in Example 1, except that a red sensitive silver iodobromide emulsion (having a silver iodide content of 8.0 mol%) was used in place of the red-sensitive high silver chloride emulsion in Samples Nos. 101 to 106, respectively.

The following sensitizing dyes were used.

Sensitizing Dye I: ($6.9 \times 10^{-5}$ mol/mol of silver halide)

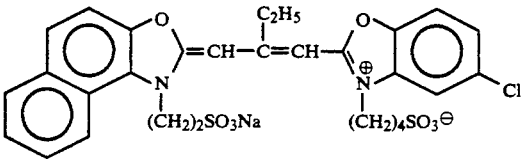

Sensitizing Dye II: ($1.8 \times 10^{-5}$ mol/mol of silver halide)

-continued

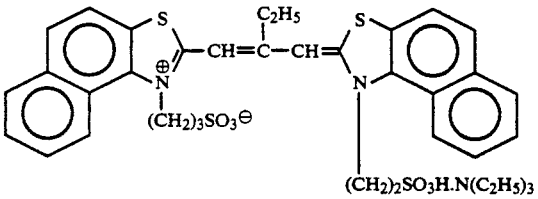

The samples thus prepared were processed using the processing procedure described below and then evaluated in the same manner as in Example 1.

As a result, the couplers of the present invention were found to have a small side absorption in the yellow range and to have a sharp toe in the shortwave side, like Example 1, and they formed dyes with excellent light fastness.

Photographic Processing Method

| Processing Step | Time | Temperature |
|---|---|---|
| Color Development | 3 min 15 sec | 38° C. |
| Bleaching | 1 min 00 sec | 38° C. |
| Bleach-Fixation | 3 min 15 sec | 38° C. |
| Rinsing (1) | 0 min 40 sec | 35° C. |
| Rinsing (2) | 1 min 00 sec | 35° C. |
| Stabilization | 0 min 40 sec | 38° C. |
| Drying | 1 min 15 sec | 55° C. |

The processing solutions used above had the following compositions.

| Color Developer: | |
|---|---|
| Diethylenetriaminepentaacetic Acid | 10.0 g |
| 1-Hydroxyethylidene-1,1-diphosphonic Acid | 3.0 g |
| Sodium Sulfite | 4.0 g |

-continued

| | |
|---|---|
| Potassium Carbonate | 30.0 g |
| Potassium Bromide | 1.4 g |
| Potassium Iodide | 1.5 mg |
| Hydroxylamine Sulfate | 2.4 g |
| 4-[N-Ethyl-N-β-hydroxyethylamino]-2-methylaniline Sulfate | 4.5 g |
| Water to make | 1.0 liter |
| pH | 10.05 |
| Bleaching Solution: | |
| Ammonium Ethylenediaminetetra acetato/Iron(III) Dihydrate | 120.0 g |
| Disodium Ethylenediaminetetra-acetate | 10.0 g |
| Ammonium Bromide | 100.0 g |
| Ammonium Nitrate | 10.0 g |
| Bleaching Accelerator | 0.005 mol |

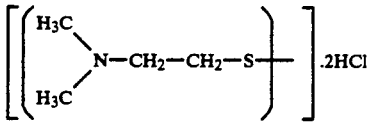

| | |
|---|---|
| Aqueous Ammonia (27%) | 15.0 ml |
| Water to make | 1.0 liter |
| pH | 6.3 |
| Bleach-Fixing Solution: | |
| Ammonium Ethylenediaminetetra-acetato/Iron(III) Dihydrate | 50.0 g |
| Disodium Ethylenediaminetetraacetate | 5.0 g |
| Sodium Sulfite | 12.0 g |
| Aqueous Ammonium Thiosulfate Solution (70%) | 240.0 ml |
| Aqueous Ammonia (27%) | 6.0 ml |
| Water to make | 1.0 liter |
| pH | 7.2 |

Rinsing Solution

City water was passed through a mixed bed type column filled with an H-type strong acidic cation-exchange resin (Amberlite IR-120B, produced by Rhom & Haas Co.) and an OH-type strong basic anion-exchange resin (Amberlite IRA-400, produced by Rhom & Haas Co.) so that both the calcium ion concentration and the magnesium ion concentration in the water were reduced to 3 mg/liter, individually. Next, 20 ml/liter of sodium dichloroisocyanurate and 150 mg/liter of sodium sulfate were added to the resulting water, which had a pH within the range of from 6.5 to 7.5. This was used as the rinsing water.

| | |
|---|---|
| Stabilizing Solution: | |
| Formaldehyde (37%) | 2.0 ml |
| Polyoxyethylene-p-monononylphenyl Ether (mean polymerization degree 10) | 0.3 g |
| Disodium Ethylenediaminetetraacetate | 0.05 g |
| Water to make | 1.0 liter |
| pH | 5.0 to 8.0 |

EXAMPLE 3

Samples prepared as in Example 1 were processed in accordance with the processing method described below and the processed samples were tested and evaluated in the same manner as in Example 1.

The results obtained are shown in Table 3 below.

-continued

Photographic Processing Method

| Processing Step | Time | Temperature |
|---|---|---|
| First Development | 6 min | 38° C. |
| Rinsing | 2 min | 38° C. |
| Reversal | 2 min | 38° C. |
| Color Development | 6 min | 38° C. |
| Adjustment | 2 min | 38° C. |
| Bleaching | 6 min | 38° C. |
| Fixation | 4 min | 38° C. |
| Rinsing | 4 min | 38° C. |
| Stabilization | 1 min | room temperature |
| Drying | | |

The processing solutions used above had the following compositions.

| | |
|---|---|
| First Developer: | |
| Water | 700 ml |
| Pentasodium Nitrilo-N,N,N-trimethylene-phosphonate | 2 g |
| Sodium Sulfite | 20 g |
| Hydroquinone Sulfonate | 30 g |
| Sodium Carbonate Monohydrate | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1000 ml |
| pH | 9.60 |
| Reversal Processing Solution: | |
| Water | 700 ml |
| Pentasodium Nitrilo-N,N,N-trimethylene-phosphonate | 3 g |
| Stannous Chloride Dihydrate | 1 g |
| P-aminophenol | 0.1 g |
| Sodium Hydroxide | 8 g |
| Glacial Acetic Acid | 15 ml |
| Water to make | 1000 ml |
| pH | 6.0 |
| Color Developer: | |
| Water | 700 ml |
| Pentasodium Nitrilo-N,N,N-trimethylene-phosphonate | 3 g |
| Sodium Sulfite | 7 g |
| Sodium Tertiary Phosphate 12-Hydrate | 36 g |
| Potassium Bromide | 1 g |
| Potassium Iodide (0.1% solution) | 90 ml |
| Sodium Hydroxide | 3 g |
| Citrazinic Acid | 1.5 g |
| N-Ethyl-N-(β-methanesulfonamidoethyl)-3-methyl-4-aminoaniline Sulfate | 11 g |
| 3,6-Dithiooctane-1,8-diol | 1 g |
| Water to make | 1000 ml |
| pH | 11.80 |
| Adjusting Solution: | |
| Water | 700 ml |
| Sodium Sulfite | 12 g |
| Sodium Ethylenediaminetetraacetate Dihydrate | 8 g |
| Thioglycerine | 0.4 ml |
| Glacial Acetic Acid | 3 ml |
| Water to make | 1000 ml |
| pH | 6.0 |
| Bleaching Solution: | |
| Water | 800 ml |
| Sodium Ethylenediaminetetraacetate Dihydrate | 2 g |
| Ammonium Ethylenediaminetetra-acetato/Iron(III) Dihydrate | 120 g |
| Potassium Bromide | 100 g |
| Water to make | 1000 ml |
| pH | 5.70 |
| Fixing Solution: | |
| Water | 800 ml |
| Sodium Thiosulfate | 80.0 g |
| Sodium Sulfite | 5.0 g |
| Sodium Bisulfite | 5.0 g |

-continued

| | |
|---|---|
| Water to make | 1000 ml |
| pH | 6.60 |
| Stabilizing Solution: | |
| Water | 800 ml |
| Formaldehyde (37 wt %) | 5.0 ml |
| Fuji Drywell (surfactant, product by Fuji Photo Film Co.) | 5.0 ml |
| Water to make | 1000 ml |
| pH | 7.0 |

TABLE 3

| Sample No. | Coupler | Side Absorption(*) | Sharpness of Toe in Short-wave Side(*) | λmax | Light Fastness | Remarks |
|---|---|---|---|---|---|---|
| 101 | A-1 | 1.00 | 1.00 | 644 nm | 78% | Comparative Sample |
| 102 | (A-II) | 0.81 | 0.80 | 601 nm | 63% | Comparative Sample |
| 103 | Coupler (1) | 0.62 | 0.71 | 642 nm | 94% | Sample of Invention |
| 104 | Coupler (2) | 0.60 | 0.70 | 615 nm | 94% | Sample of Invention |
| 105 | Coupler (7) | 0.50 | 0.68 | 635 nm | 95% | Sample of Invention |
| 106 | Coupler (15) | 0.51 | 0.67 | 610 nm | 93% | Sample of Invention |

(*)Relative Value to the value of Sample No. 101.

From the results in Table 3 above, it can be seen that the couplers of the present invention have excellent absorption characteristics and they displayed an improved color reproducibility especially in reproduction of green color.

In addition, it can also be seen that the dyes formed from the couplers of the present invention have an excellent light fastness.

EXAMPLE 4

One surface of a paper support, both surfaces of which were laminated with polyethylene, was subjected to corona-discharging, and a gelatin-subbing layer containing sodium dodecylbenzenesulfonate was formed thereon. Then, plural photographic layers were coated on the subbing layer to form a multi-layer color photographic paper (Sample No. 401). The coating compositions for the plural layers were prepared as described below.

Preparation of First Layer-Coating Composition 27.2 g of ethyl acetate, 4.1 g of solvent (Solv3) and 4.1 g of solvent (Solv-7) were added to 19.1 g of yellow coupler (ExY), 4.4 g of color image stabilizer (Cpd-1) and 7.7 g of color image stabilizer (Cpd-7) and dissolved, and the resulting solution was added to 185 cc of an aqueous 10 % gelatin solution containing 8 cc of 10 % sodium dodecylbenzenesulfonate and then dispersed by emulsification to prepare an Emulsified Dispersion (A). On the other hand, a silver chlorobromide Emulsion (A) was prepared, which was a (3/7, by mol of silver) mixture of a large-size cubic grain Emulsion (A) with a mean grain size of 0.88 μm and a small-size cubic grain Emulsion (A) with a mean grain size of 0.70 μm. The large grain size and small grain size emulsions had a coefficient of variation of grain size distribution of 0.08 and 0.10, respectively; and both had 0.3.mol% of silver bromide partly and locally on the surfaces of the grains. The emulsion mixture contained the following blue-sensitizing Dyes A and B each in an amount of $2.0\times10^{-4}$ mol per mol of silver halide in the large grain size Emulsion (A) and each in an amount of $2.5\times10^{-4}$ mol per mol of silver halide in the small grain size Emulsion (A). Chemical ripening of the emulsion mixture was effected with a sulfur sensitizing agent and a gold sensitizing agent. The previously prepared Emulsified Dispersion (A) and the silver chlorobromide Emulsion (A) mixture were blended to prepare a coating composition for the First Layer, which comprised the components described below.

Other coating compositions for the Second Layer to the Seventh Layer were prepared in the same manner as above. (Also in the coating composition for the Fifth Layer, cyan coupler and color image stabilizer (Cpd-7) were dissolved in ethyl acetate and then dispersed by emulsification.) 1-Hydroxy-3,5-dichloro-s-triazine sodium salt was used as a gelatin-hardening agent in each layer.

(Cpd-10) and (Cpd-11) were added to each layer in an amount of 25.0 mg/m$^2$ and 50.0 mg/m$^2$ each as the total amount in the sample.

The following color-sensitizing dyes were added to the silver chlorobromide emulsion in the respective light-sensitive layers.

Sensitizing Dye A for Blue-sensitive Emulsion Layer:

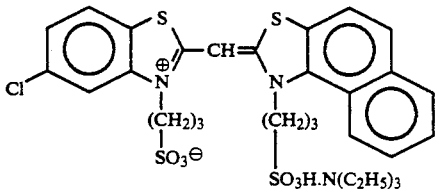

($2.0\times10^{-4}$ mol per mol of silver halide to large grain size Emulsion A; $2.5\times10^{-4}$ mol per mol of silver halide to small grain size Emulsion A)

Sensitizing Dye B for Blue-sensitive Emulsion Layer:

-continued

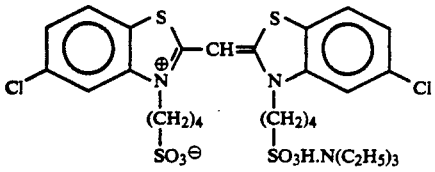

($2.0 \times 10^{-4}$ mol per mol of silver halide to large grain size Emulsion A; $2.5 \times 10^{-4}$ mol per mol of silver halide to small grain size Emulsion A)

Sensitizing Dye C for Green-sensitive Emulsion Layer:

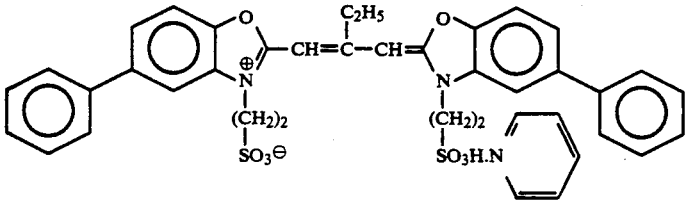

($4.0 \times 10^{-4}$ mol per mol of silver halide to large grain size Emulsion B; $5.6 \times 10^{-4}$ mol per mol of silver halide to small grain size Emulsion B)

Sensitizing Dye D for Green-sensitive Emulsion Layer:

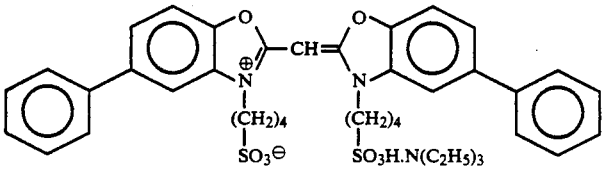

($7.0 \times 10^{-5}$ mol per mol of silver halide to large grain size Emulsion B; $1.0 \times 10^{-5}$ mol per mol of silver halide to small grain size Emulsion B)

Sensitizing Dye E for Red-sensitive Emulsion Layer:

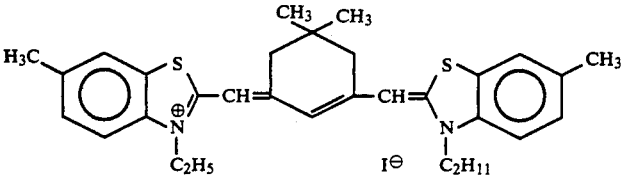

($0.9 \times 10^{-5}$ mol per mol of silver halide to large grain size Emulsion C; $1.1 \times 10^{-4}$ mol per mol of silver halide to small grain size Emulsion C)

To the red-sensitive emulsion layer was added the following compound in an amount of $2.6 \times 10^{-3}$ mol per mol of silver.

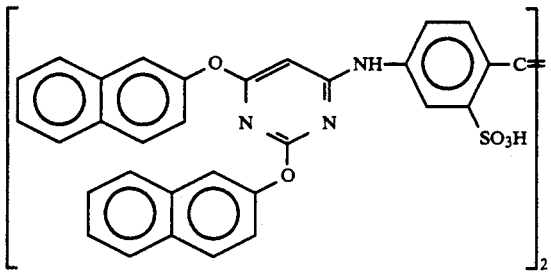

To the blue-sensitive emulsion layer, the green-sensitive emulsion layer and the red-sensitive emulsion layer was added 1-(5-methylureidophenyl)-5-mercaptotetrazole in an amount of $8.5 \times 10^{-5}$ mol, $7.7 \times 10^{-4}$ mol and $2.5 \times 10^{-4}$ mol, respectively, per mol of silver halide.

To the blue-sensitive emulsion layer and the green-sensitive emulsion layer was added 4-hydroxy-6-methyl-1,3,3a-7-tetrazaindene in an amount of $1 \times 10^{-4}$ mol and $2 \times 10^{-4}$ mol, respectively, per mol of silver halide.

The following dyes were added to the emulsion layers for anti-irradiation, each in the amount set forth within the parentheses.

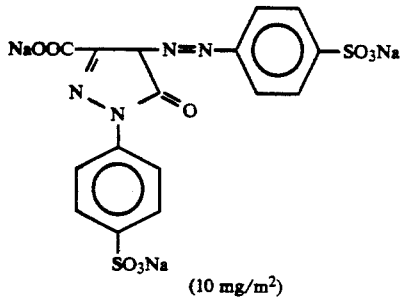

(10 mg/m²)

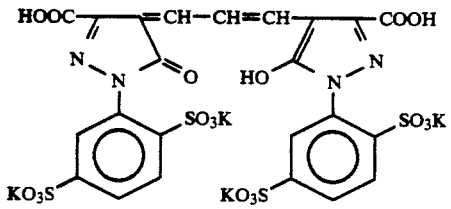

(10 mg/m²)

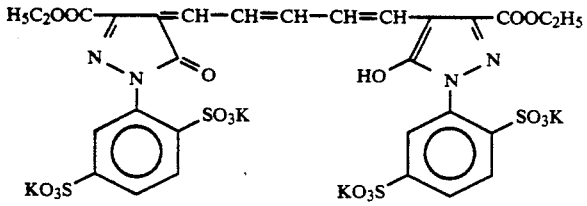

(40 mg/m²)

and

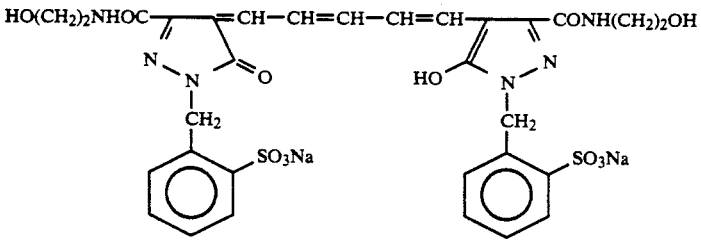

(20 mg/m²)

Compositions of Layers

The compositions of the layers are shown below. The number indicates the amount coated in units of g/m². The amount of silver halide emulsion coated is represented by the amount of silver therein.

| | |
|---|---|
| Support: | |
| Polyethylene-Laminated Paper (containing white pigment ($TiO_2$) and bluish dye (ultramarine) in polyethylene at the first layer side) | |
| First Layer (Blue-sensitive Emulsion Layer): | |
| Silver Bromochloride Emulsion (A) | 0.30 |
| Gelatin | 1.86 |
| Yellow Coupler (ExY) | 0.82 |
| Color Image Stabilizer (Cpd-1) | 0.19 |
| Solvent (Solv-3) | 0.18 |
| Solvent (Solv-7) | 0.18 |
| Color Image Stabilizer (Cpd-7) | 0.06 |
| Second Layer (Color Mixing Preventing Layer): | |
| Gelatin | 0.99 |
| Color Mixing Preventing Agent (Cpd-5) | 0.08 |
| Solvent (Solv-1) | 0.16 |

-continued

| | |
|---|---|
| Solvent (Solv-4) | 0.08 |
| Third Layer (Green-sensitive Emulsion Layer): | |
| Silver Chlorobromide Emulsion (1/3 (by mol as Ag) mixture of large-grain size Emulsion B of Large-size cubic grains with a mean grain size of 0.55 micron and coefficient of variation of grain size distribution of 0.10 and small-size Emulsion B of small-size cubic grains with a mean grain size of 0.39 micron and a coefficient of variation of grain size distribution of 0.08; both large-size and small-size grains locally had 0.8 mol % of AgBr on a part of the surface of the grain) | 0.12 |
| Gelatin | 1.24 |
| Magenta Coupler (ExM) | 0.23 |
| Color Image Stabilizer (Cpd-2) | 0.03 |
| Color Image Stabilizer (Cpd-3) | 0.16 |
| Color Image Stabilizer (Cpd-4) | 0.02 |
| Color Image Stabilizer (Cpd-9) | 0.02 |
| Solvent (Solv-2) | 0.40 |
| Fourth Layer (Ultraviolet Absorbing Layer): | |
| Gelatin | 1.58 |
| Ultraviolet Absorbent (UV-1) | 0.47 |
| Color Mixing Preventing Agent (Cpd-5) | 0.05 |
| Solvent (Solv-5) | 0.24 |

-continued

| | |
|---|---|
| Fifth Layer (Red-sensitive Emulsion Layer): | |
| Silver Chlorobromide Emulsion (1/3 (by mol as Ag) mixture of large-size Emulsion C of large-size cubic grains with a mean grain size of 0.58 micron and coefficient of variation of grain size distribution of 0.09 and small-size Emulsion C of small-size cubic grains with a mean grain size of 0.45 micron and a coefficient of variation of grain size distribution of 0.11; both large-size and small-size grains locally had 0.6 mol % of AgBr on a part of the surface of the grain) | 0.23 |
| Gelatin | 1.34 |
| Cyan Coupler (ExC) | 0.32 |
| Color Image Stabilizer (Cpd-2) | 0.03 |
| Color Image Stabilizer (Cpd-4) | 0.02 |
| Color Image Stabilizer (Cpd-6) | 0.18 |
| Color Image Stabilizer (Cpd-7) | 0.40 |

-continued

| | |
|---|---|
| Color Image Stabilizer (Cpd-8) | 0.05 |
| Solvent (Solv-6) | 0.14 |
| Sixth Layer (Ultraviolet Absorbing Layer): | |
| Gelatin | 0.53 |
| Ultraviolet Absorbent (UV-1) | 0.16 |
| Color Mixing Preventing Agent (Cpd-5) | 0.02 |
| Solvent (Solv-5) | 0.08 |
| Seventh Layer (Protective Layer): | |
| Gelatin | 1.33 |
| Acryl-modified Copolymer of Polyvinyl Alcohol (modification degree 17%) | 0.17 |
| Liquid Paraffin | 0.03 |

The compounds used in the layers as described were as follows:

(ExY) Yellow Coupler:
1/1 (by mol) mixture of the following compounds:

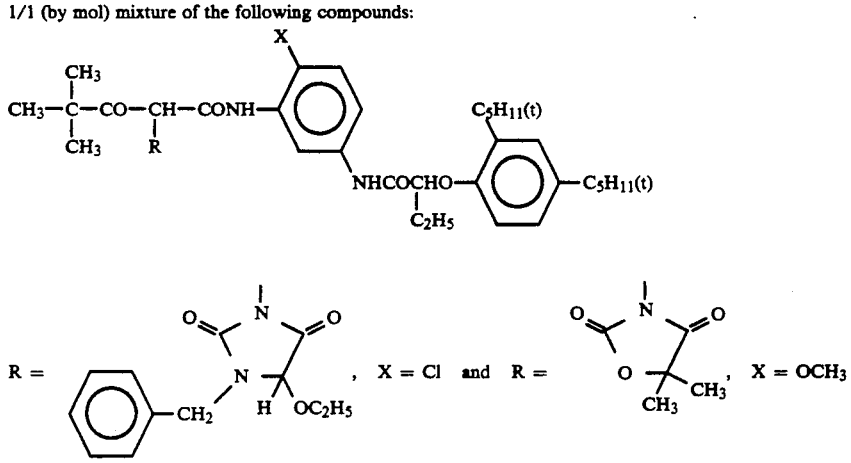

(ExM) Magenta Coupler:

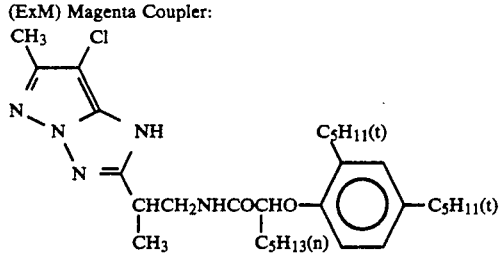

(ExC) Cyan Coupler:
1/1 (by mol) mixture of the following compounds:

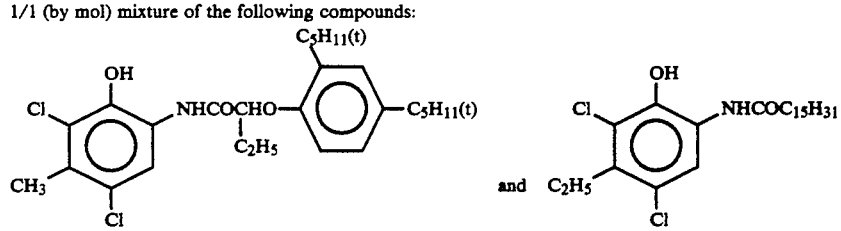

(Cpd-1) Color Image Stabilizer:

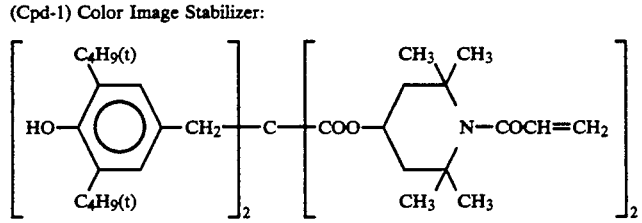

(Cpd-2) Color Image Stabilizer:

-continued
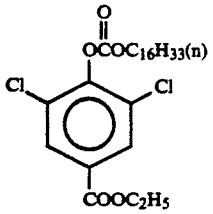
(Cpd-3) Color Image Stabilizer:
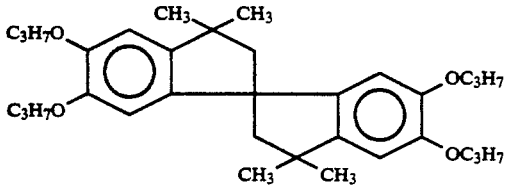
(Cpd-4) Color Image Stabilizer:
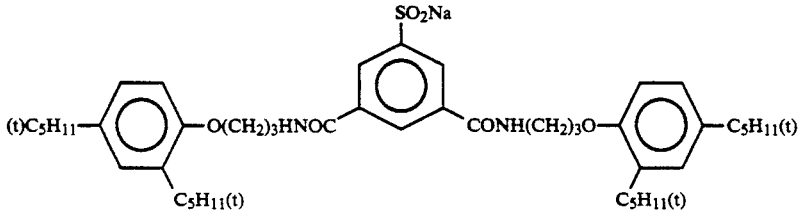
(Cpd-5) Color Mixing Preventing Agent:
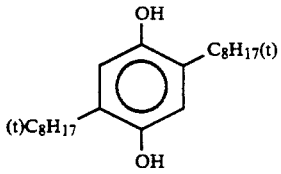
(Cpd-6) Color Image Stabilizer:
2/4/4 (by weight) mixture of the following compounds:
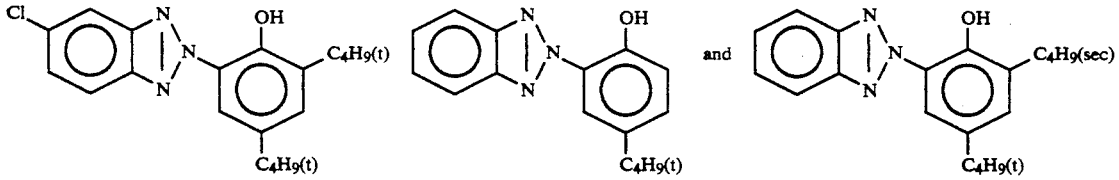
(Cpd-7) Color Image Stabilizer:
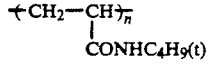
(mean molecular weight 60,000)
(Cpd-8) Color Image Stabilizer:
1/1 (by weight) mixture of the following compounds:
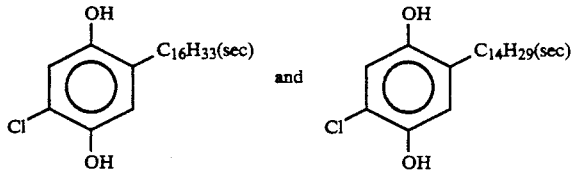
(Cpd-9) Color Image Stabilizer:

-continued
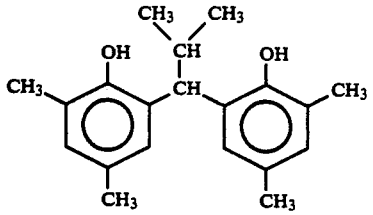
(Cpd-10) Antiseptic:
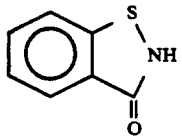
(Cpd-11) Antiseptic:
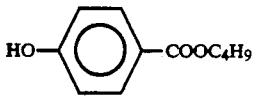
(UV-1) Ultraviolet Absorbent:
4/2/4 (by weight) mixture of the following compounds:
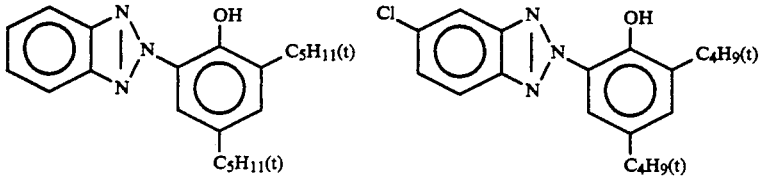
and
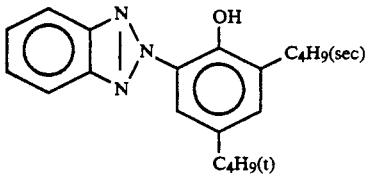
(Solv-1) Solvent:
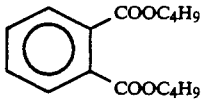
(Solv-2) Solvent:
1/1 (by volume) mixture of the following compounds:
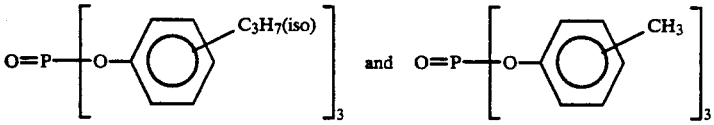
(Solv-3) Solvent:
$O{=}P{+}O{-}C_9H_{19}(iso)]_3$
(Solv-4) Solvent:
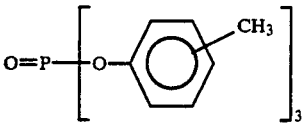
(Solv-5) Solvent:

-continued $$\begin{array}{l} COOC_8H_{17} \\ | \\ (CH_2)_8 \\ | \\ COOC_8H_{17} \end{array}$$

(Solv-6) Solvent:
80/20 (by volume) mixture of the following compounds:

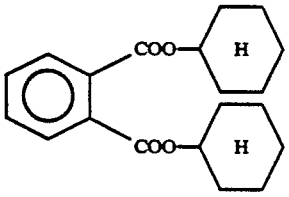

and $C_8H_{17}CH\underset{O}{\underset{\backslash /}{}}CH(CH_2)_7COOC_8H_{17}$ (Solv-7) Solvent:
$C_8H_{17}CH\underset{O}{\underset{\backslash /}{}}CH(CH_2)_7COOC_8H_{17}$ Preparation of Samples Nos. 402 to 406

Samples Nos. 402 to 406 ere prepared in the same manner as in the preparation of Sample No. 401, except that ExM in the Third Layer and ExC in the Fifth Layer were replaced by the same molar amounts of the couplers respectively shown in Table 4 below.

A negative film considered to be a standard with an image of an object, being used for Sample No. 402, Sample No. 402 was continuously processed with an automatic developing machine in accordance with the processing procedure described below, until the amount of the replenisher used to replenish the color developer tank became two times the capacity of the tank as a running test. In the process, processing solutions mentioned below were used. After the running test, all the samples (Samples Nos. 401 to 406) were processed with the same machine for testing the photographic properties of them.

| Processing Steps | Processing Steps | | | |
|---|---|---|---|---|
| | Temperature | Time | Replenisher(*) | Capacity of Tank |
| Color Development | 35° C. | 45 sec | 161 ml | 17 liters |
| Bleach-fixation | 30 to 35° C. | 45 sec | 215 ml | 17 liters |
| Rinsing (1) | 30 to 35° C. | 20 sec | — | 10 liters |
| Rinsing (2) | 30 to 35° C. | 20 sec | — | 10 liters |
| Rinsing (3) | 30 to 35° C. | 20 sec | 350 ml | 10 liters |
| Drying | 70 to 80° C. | 60 sec | | |

(*)Amount of replenisher per $m^2$ of sample being processed.
(Rinsing was effected using a three-tank countercurrent system from rinsing tank (3) to rinsing tank (1).)

The processing solutions used in the abovedescribed steps had the following compositions.

| | Tank Solution | Replenisher |
|---|---|---|
| Color Development | | |
| Water | 800 ml | 800 ml |
| Ethylenediamine-N,N,N,N-tetramethylenephosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| N,N-bis(Carboxymethyl)-hydrazine | 4.0 g | 5.0 g |
| N,N-di(Sulfoethyl)hydroxylamine/1 Na | 4.0 g | 5.0 g |
| Brightening Agent (WHITEX 4B, product of Sumitomo Chemical Co.) | 1.0 g | 2.0 g |
| Water to make | 1000 ml | 1000 ml |
| pH (25° C.) | 10.05 | 10.45 |
| Bleach-Fixing Solution: | | |
| (Tank solution and replenisher were same.) | | |
| Water | 400 ml | |
| Ammonium Thiosulfate (70%) | 100 ml | |
| Sodium Sulfite | 17 g | |
| Ammonium Ethylenediaminetetraacetato/Iron(III) | 55 g | |
| Disdium Ethylenediaminetetraacetate | 5 g | |
| Ammonium Bromide | 40 g | |
| Water to make | 1000 ml | |
| pH (25° C.) | 6.0 | |
| Rinsing Solution: | | |
| (Tank solution and replenisher were same.) | | |
| Ion-exchange Water (with a calcium content of 3 ppm or less and a magnesium content of 3 ppm or less). | | |

To evaluate the color reproducibility of Samples Nos. 401 to 406, the samples were printed using a developed color negative film considered to be a standard having an image of an object, and thereafter processed in accordance with the processing procedure described above. The images formed on the thus processed samples were visually evaluated with the naked eye, and the results obtained are shown in Table 4 below. Specifically, evaluation was effected on the basis of Sample No. 401 as a control sample, and the mark "◎" means that the tested sample was much superior to Sample No. 401, the mark "○" means that the tested sample was superior to Sample No. 401, the mark "Δ" means that the tested sample was comparable to Sample No 401, and the mark "×" means that the tested sample was inferior to Sample No. 401.

To evaluate the light fastness of the cyan image formed in each sample, each sample was wedgewise exposed through a three-color separation filter and then processed in accordance with the processing procedure described above. Evaluation of the light fastness of the cyan image formed on each sample was effected in the same manner as in Example 1.

The results obtained are shown in Table 4 below.

TABLE 4

| Sample | Coupler in 3rd Layer | Coupler in 5th Layer | Color Reproducibility | Light Fastness of Cyan Image | Remarks |
|---|---|---|---|---|---|
| 401 | ExM | ExC | Control | 88% | Comparative Sample |
| 402 | ExM | Cyan Coupler (1) | ◎ | 97% | Sample of Invention |
| 403 | ExM | Cyan Coupler (7) | ◎ | 96% | Sample of Invention |
| 404 | ExM' | Cyan Coupler (1) | ∘ | 96% | Sample of Invention |
| 405 | ExM' | Cyan Coupler (2) | ∘ | 95% | Sample of Invention |
| 406 | ExM' | ExC | x | 87% | Comparative Sample |

ExM':

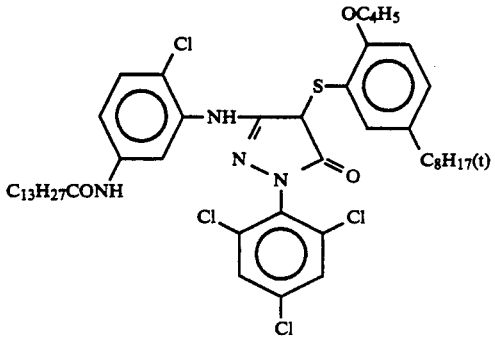

As is obvious from the results shown in Table 4 above, the samples of the present invention had excellent color reproducibility. In particular, the samples containing a combination of a pyrazoloazole magenta coupler and the cyan coupler of formula (I) of the present invention displayed an especially improved color reproducibility.

The photographic materials of the present invention which contain a particular cyan coupler of formula (I) have an excellent color reproducibility and provide a cyan image with a high color fastness.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support thereon having at least one red-sensitive silver halide emulsion layer, in which the red-sensitive halide emulsion layer contains at least one cyan coupler of the general formula (I):

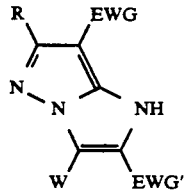

(I)

wherein R represents a substituent;

EWG represents a cyano group;

EWG' represents an alkoxycarbonyl group or an aryloxycarbonyl group; and

W represents a hydrogen atom or a releasable group which splits off on reaction of the coupler with an oxidation product of an aromatic primary amine developing agent.

2. The silver halide color photographic material as in claim 1, which contains at least one pyrazoloazole magenta coupler, which pyrazoloazole magenta coupler is contained in a green-sensitive silver halide emulsion layer.

3. The silver halide color photographic material as in claim 2, wherein said pyrazoloazole magenta coupler is a pyrazolozaole magenta coupler of the general formula (M):

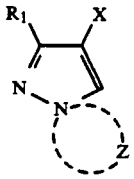

(M)

wherein $R_1$ represents a hydrogen atom or a substituent;

Z represents a non-metallic atomic group necessary for forming a 5-membered azole ring containing from 2 to 4 nitrogen atoms, and the azole ring may be substituted and may include a condensed ring; and X represents a hydrogen atom or a group releasable from the formula on coupling with an oxidation product of an aromatic primary amine developing agent.

4. The silver halide color photographic material as in claim 2, wherein the pyrazoloazole magenta coupler is contained in an amount of from 0.001 to 1 mol per mol of silver halide.

5. The silver halide color photographic material as in claim 1, wherein W in the formula (I) represents a hydrogen atom; a halogen atom; an aromatic azo group; a group bonded to an aliphatic group, an aromatic group, a heterocyclic group, an aliphatic, aromatic or heterocyclic sulfonyl group, or an aliphatic, aromatic or heterocyclic carbonyl group, via an oxygen, nitrogen, sulfur, or carbon atom; or a heterocyclic group bonded to the coupling position of the formula via a nitrogen atom of the group.

6. The silver halide color photographic material as in claim 1, wherein the cyan coupler of formula (I) is present in an amount of from $1\times10^{-3}$ mol to 1 mol per mol of silver halide in the layer.

* * * * *